US005648630A

United States Patent [19]

Vandervoort

[11] Patent Number: 5,648,630

[45] Date of Patent: Jul. 15, 1997

[54] SYSTEM FOR TRIGGERING AND MUTING MUSICAL TONES EMPLOYING TWO OF MORE KEYBOARD KEYS WHICH OPERATE INTERACTIVELY

[76] Inventor: Paul B. Vandervoort, 2875 Idlewild #19, Reno, Nev. 89509

[21] Appl. No.: 512,547

[22] Filed: Aug. 8, 1995

Related U.S. Application Data

[63] Continuation-in-part of Ser. No. 345,067, Nov. 22, 1994, Pat. No. 5,505,115, which is a continuation-in-part of Ser. No. 191,283, Feb. 3, 1994, abandoned, which is a continuation-in-part of Ser. No. 40,209, Apr. 1, 1993, Pat. No. 5,469,772.

[51] Int. Cl.[6] ..... G10H 1/32

[52] U.S. Cl. ..... 84/719; 84/600; 84/645; 84/744

[58] Field of Search ..... 84/719, 720, 744, 84/745, 600, 645

[56] References Cited

U.S. PATENT DOCUMENTS

| | | | |
|---|---|---|---|
| 3,200,689 | 8/1965 | Roseberger | 84/451 X |
| 3,468,209 | 9/1969 | Barreto | 84/423 |
| 4,031,800 | 6/1977 | Thompson | 84/423 |
| 4,263,829 | 4/1981 | Kaneko et al. . | |
| 4,304,161 | 12/1981 | Franzman | 84/719 |
| 4,335,639 | 6/1982 | Okamoto . | |
| 4,480,519 | 11/1984 | Allen . | |
| 5,099,738 | 3/1992 | Hotz . | |
| 5,323,679 | 6/1994 | Riday . | |
| 5,469,772 | 11/1995 | Vandervoort . | |
| 5,505,115 | 4/1996 | Vandervoort . | |
| 5,515,763 | 5/1996 | Vandervoort . | |

*Primary Examiner*—Jonathan Wysocki
*Assistant Examiner*—Jeffrey W. Donels

[57] ABSTRACT

A polyphonic electronic musical instrument is provided including a keyboard, an information processing system, e.g., a microprocessor-controlled computer system, and a tone generating device. The processing system processes data received from the keyboard and sends note-on/note-off commands to the tone-producing device. The processing system groups keys of the keyboard into "key sets". Keys within each set occupy different rows of the keyboard. The processing system commands the tone generating device to effectively produce not more than one tone corresponding with each key set at any one time regardless of how many keys within the set are depressed. A key set may operate in "sustain mode," in which depression of a first key produces a tone which sustains without interruption as long as at least any one key of the same set is in depressed position. Alternately, a key set may operate in "repetition mode." In this mode, depression of a key as a previously depressed key of the same set is held down causes the tone of the previously depressed key to mute and another tone corresponding with the newly depressed key to trigger. The two tones may be identical. A mode select function is provided whereby the user may alternate between sustain and repetition modes for one or more key sets. The preferred embodiment utilizes a 5-row Janko Keyboard with independently-moving keys.

49 Claims, 19 Drawing Sheets

FIG. 5 NOTE SELECT KEY SUBROUTINE
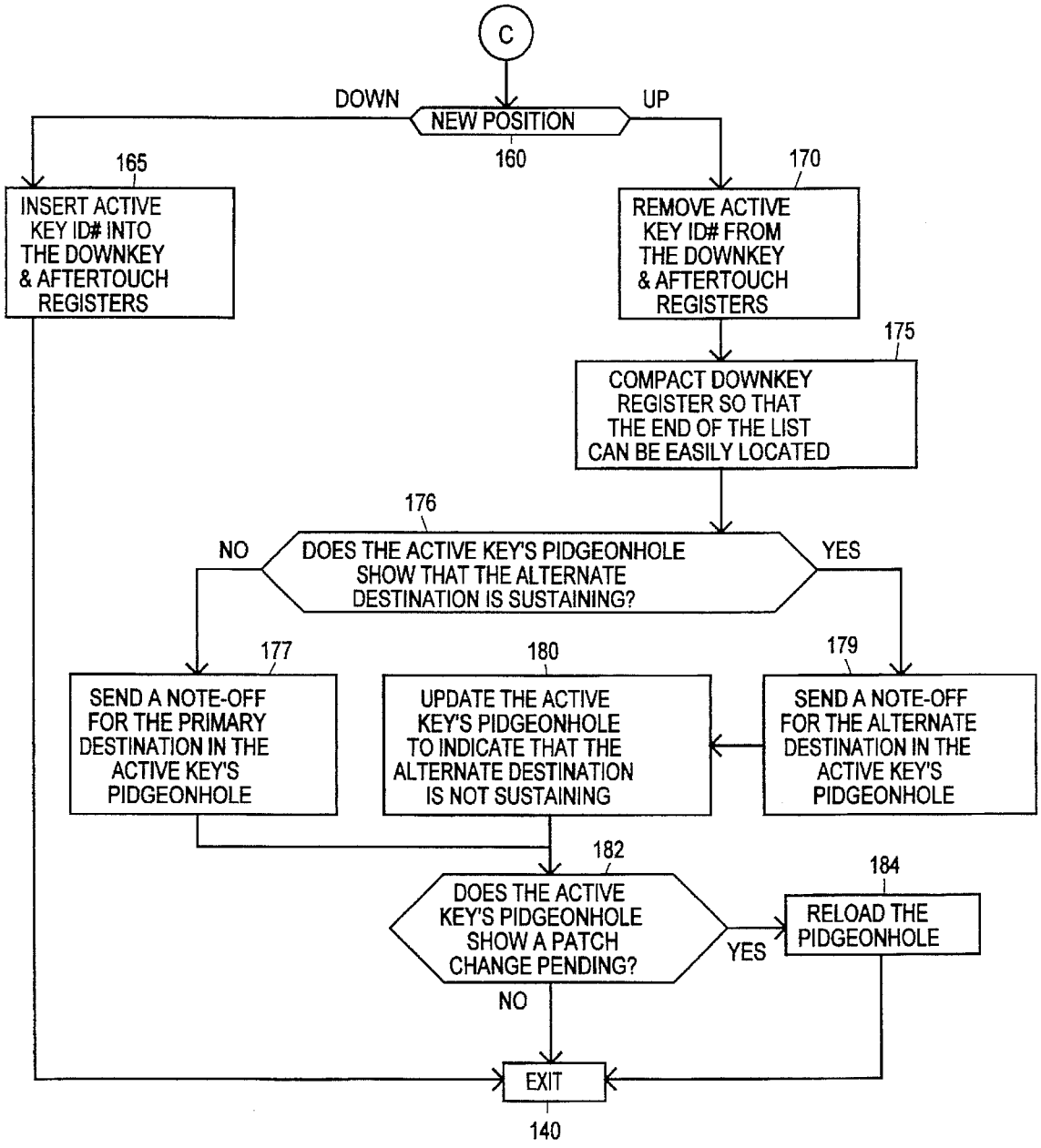

STRUM MODE 1 TRIGGER KEY SUBROUTINE

STRUM MODE 2 TRIGGER KEY SUBROUTINE

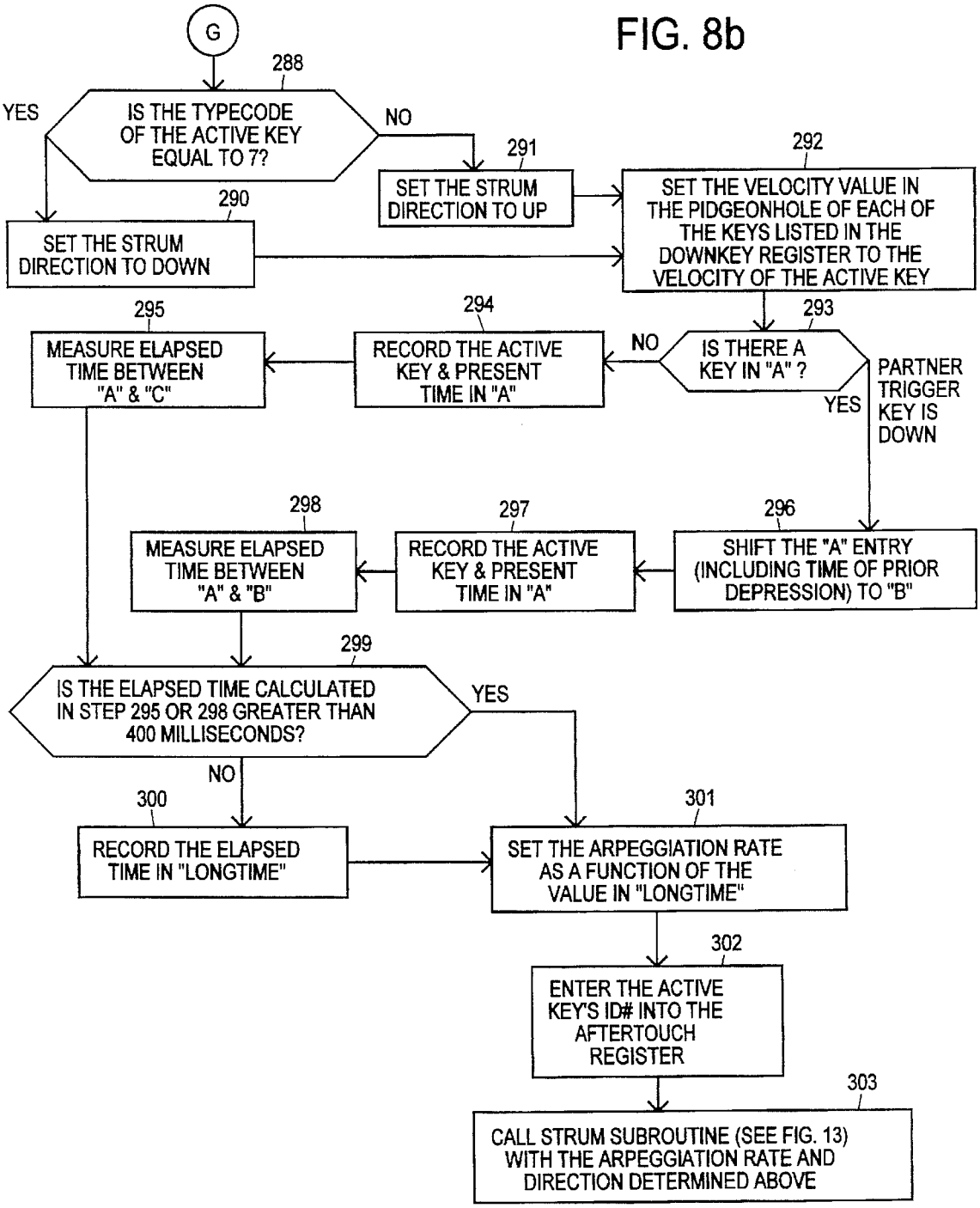
FIG. 8b
G
288
IS THE TYPECODE OF THE ACTIVE KEY EQUAL TO 7?
YES
NO
290
SET THE STRUM DIRECTION TO DOWN
291
SET THE STRUM DIRECTION TO UP
292
SET THE VELOCITY VALUE IN THE PIDGEONHOLE OF EACH OF THE KEYS LISTED IN THE DOWNKEY REGISTER TO THE VELOCITY OF THE ACTIVE KEY
293
IS THERE A KEY IN "A" ?
NO
YES
PARTNER TRIGGER KEY IS DOWN
294
RECORD THE ACTIVE KEY & PRESENT TIME IN "A"
295
MEASURE ELAPSED TIME BETWEEN "A" & "C"
296
SHIFT THE "A" ENTRY (INCLUDING TIME OF PRIOR DEPRESSION) TO "B"
297
RECORD THE ACTIVE KEY & PRESENT TIME IN "A"
298
MEASURE ELAPSED TIME BETWEEN "A" & "B"
299
IS THE ELAPSED TIME CALCULATED IN STEP 295 OR 298 GREATER THAN 400 MILLISECONDS?
YES
NO
300
RECORD THE ELAPSED TIME IN "LONGTIME"
301
SET THE ARPEGGIATION RATE AS A FUNCTION OF THE VALUE IN "LONGTIME"
302
ENTER THE ACTIVE KEY'S ID# INTO THE AFTERTOUCH REGISTER
303
CALL STRUM SUBROUTINE (SEE FIG. 13) WITH THE ARPEGGIATION RATE AND DIRECTION DETERMINED ABOVE FIG. 10 PATCH CHANGE KEY SUBROUTINE
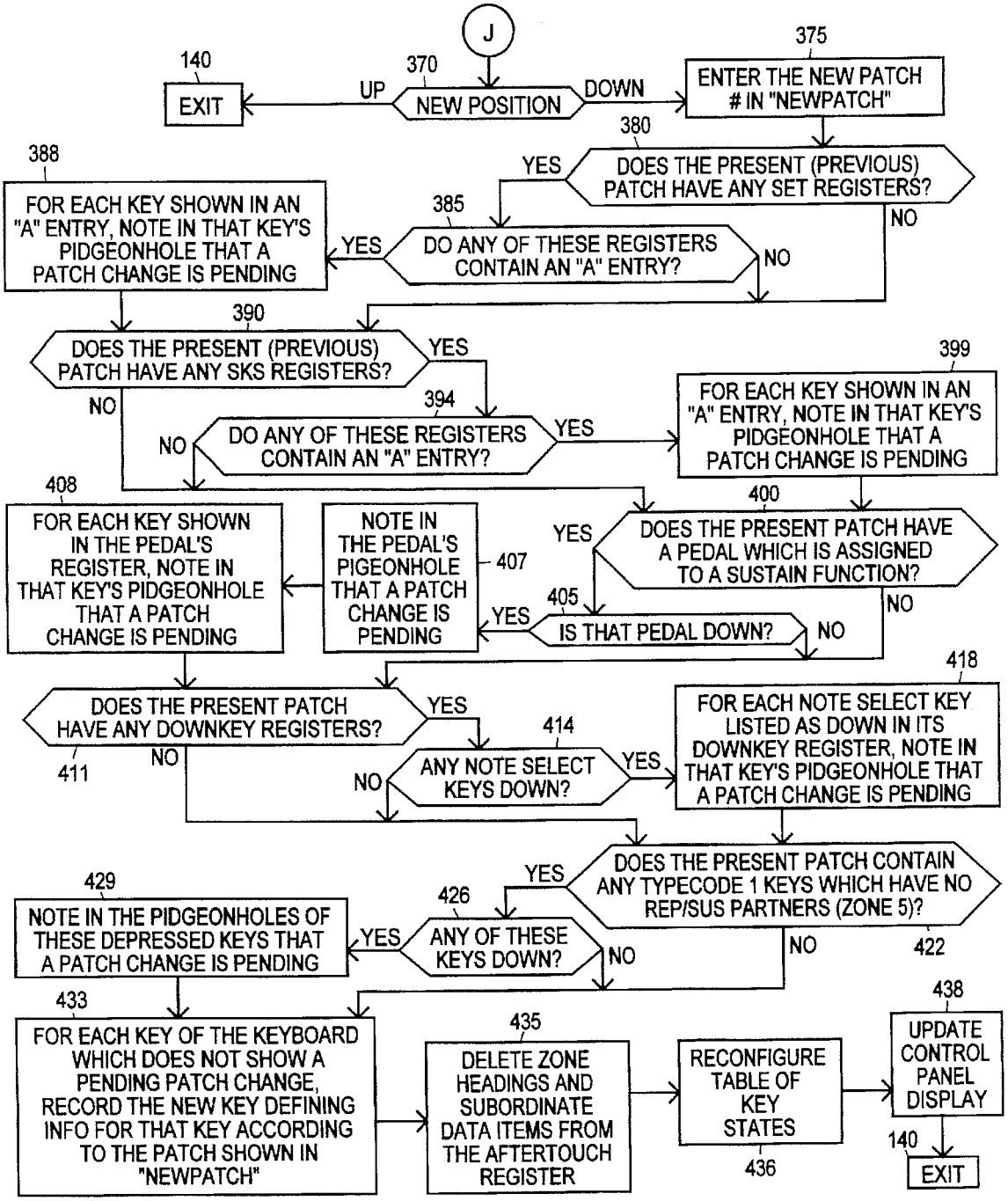

FIG. 11 SUSTAIN PEDAL SUBROUTINE
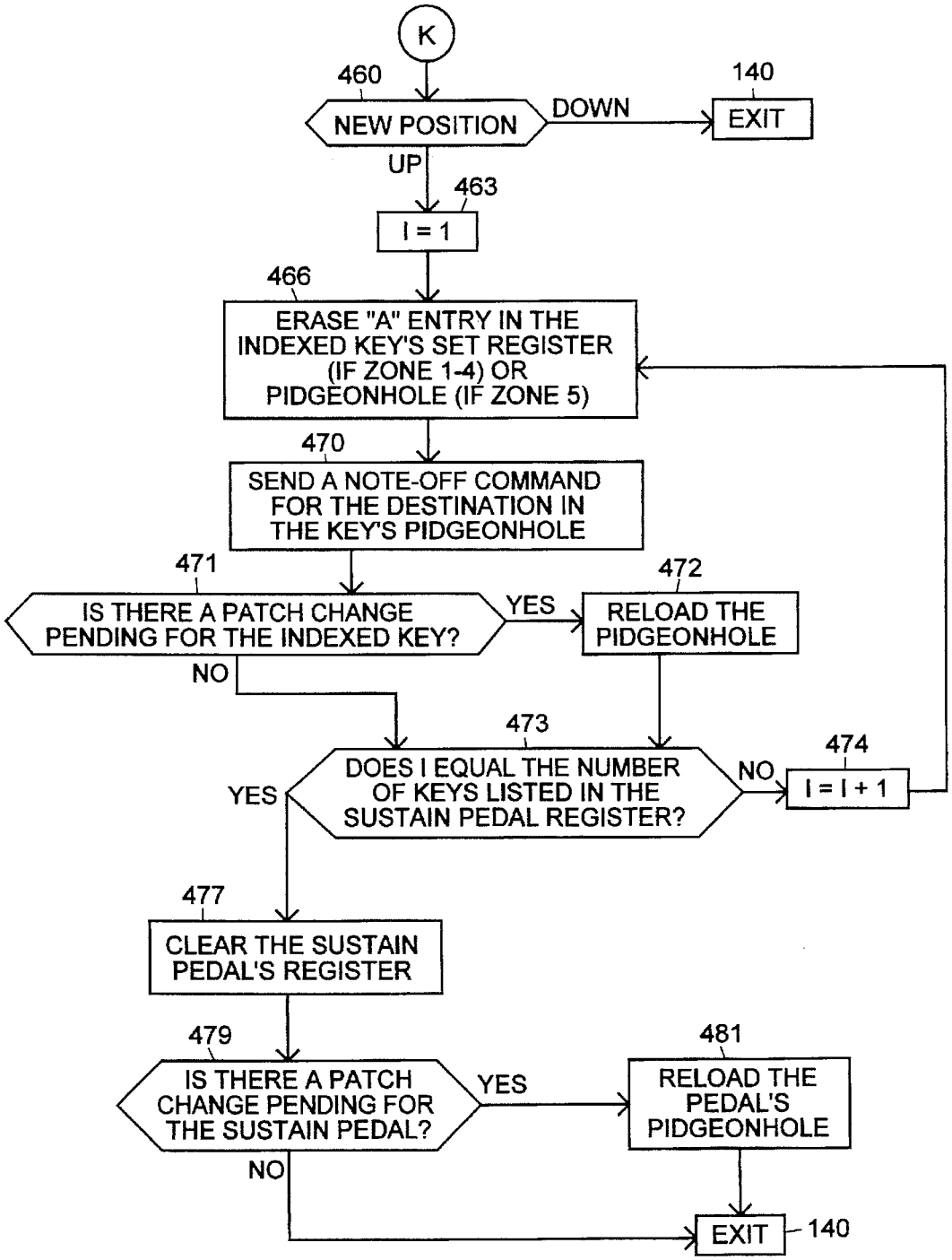

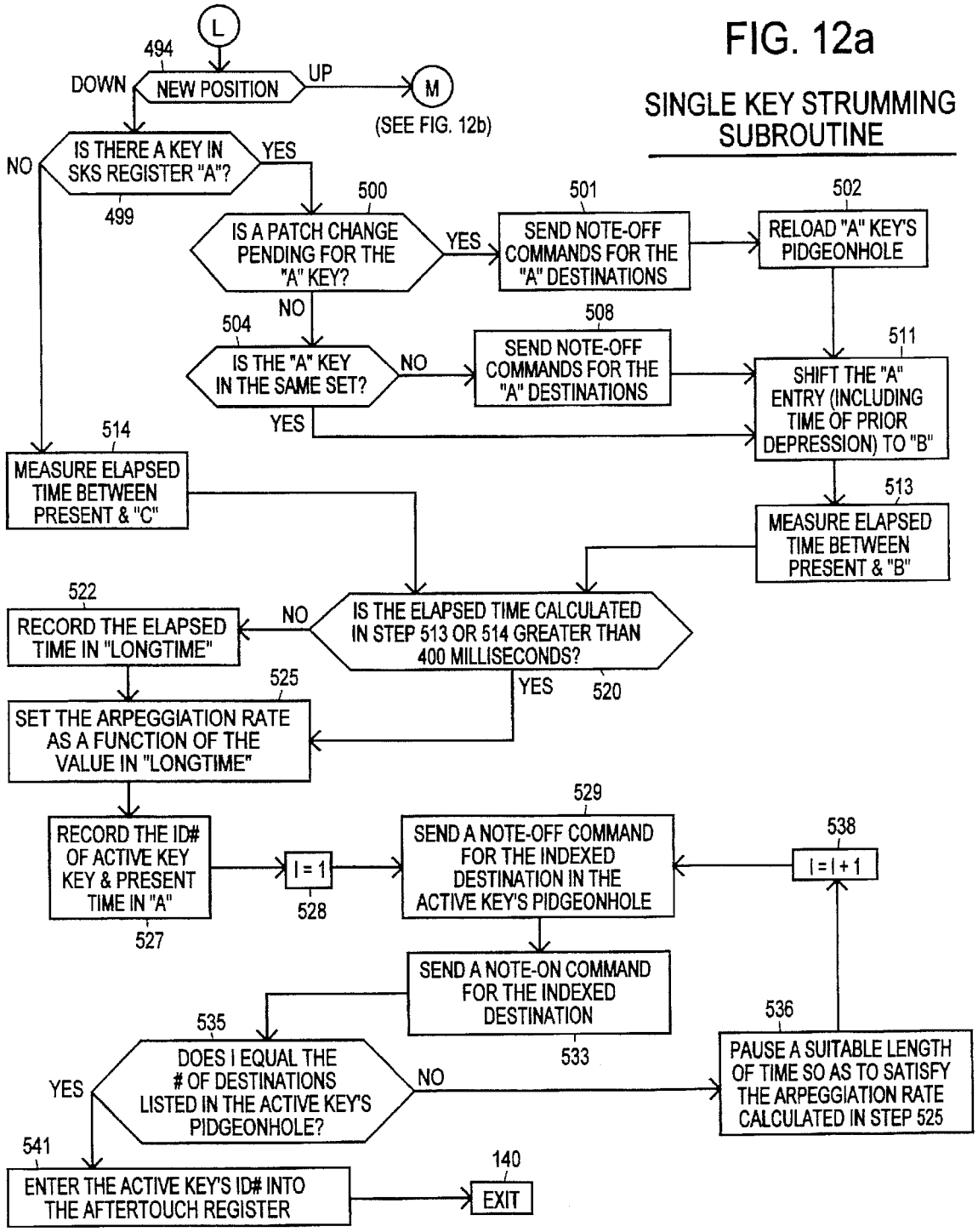
FIG. 12a
SINGLE KEY STRUMMING SUBROUTINE
L
494
NEW POSITION
DOWN
UP
M
(SEE FIG. 12b)
IS THERE A KEY IN SKS REGISTER "A"?
NO
YES
499
500
IS A PATCH CHANGE PENDING FOR THE "A" KEY?
YES
NO
501
SEND NOTE-OFF COMMANDS FOR THE "A" DESTINATIONS
502
RELOAD "A" KEY'S PIDGEONHOLE
504
IS THE "A" KEY IN THE SAME SET?
NO
YES
508
SEND NOTE-OFF COMMANDS FOR THE "A" DESTINATIONS
511
SHIFT THE "A" ENTRY (INCLUDING TIME OF PRIOR DEPRESSION) TO "B"
514
MEASURE ELAPSED TIME BETWEEN PRESENT & "C"
513
MEASURE ELAPSED TIME BETWEEN PRESENT & "B"
522
RECORD THE ELAPSED TIME IN "LONGTIME"
NO
IS THE ELAPSED TIME CALCULATED IN STEP 513 OR 514 GREATER THAN 400 MILLISECONDS?
YES
520
525
SET THE ARPEGGIATION RATE AS A FUNCTION OF THE VALUE IN "LONGTIME"
RECORD THE ID# OF ACTIVE KEY KEY & PRESENT TIME IN "A"
527
I = 1
528
529
SEND A NOTE-OFF COMMAND FOR THE INDEXED DESTINATION IN THE ACTIVE KEY'S PIDGEONHOLE
538
I = I + 1
SEND A NOTE-ON COMMAND FOR THE INDEXED DESTINATION
533
535
DOES I EQUAL THE # OF DESTINATIONS LISTED IN THE ACTIVE KEY'S PIDGEONHOLE?
YES
NO
536
PAUSE A SUITABLE LENGTH OF TIME SO AS TO SATISFY THE ARPEGGIATION RATE CALCULATED IN STEP 525
541
ENTER THE ACTIVE KEY'S ID# INTO THE AFTERTOUCH REGISTER
140
EXIT

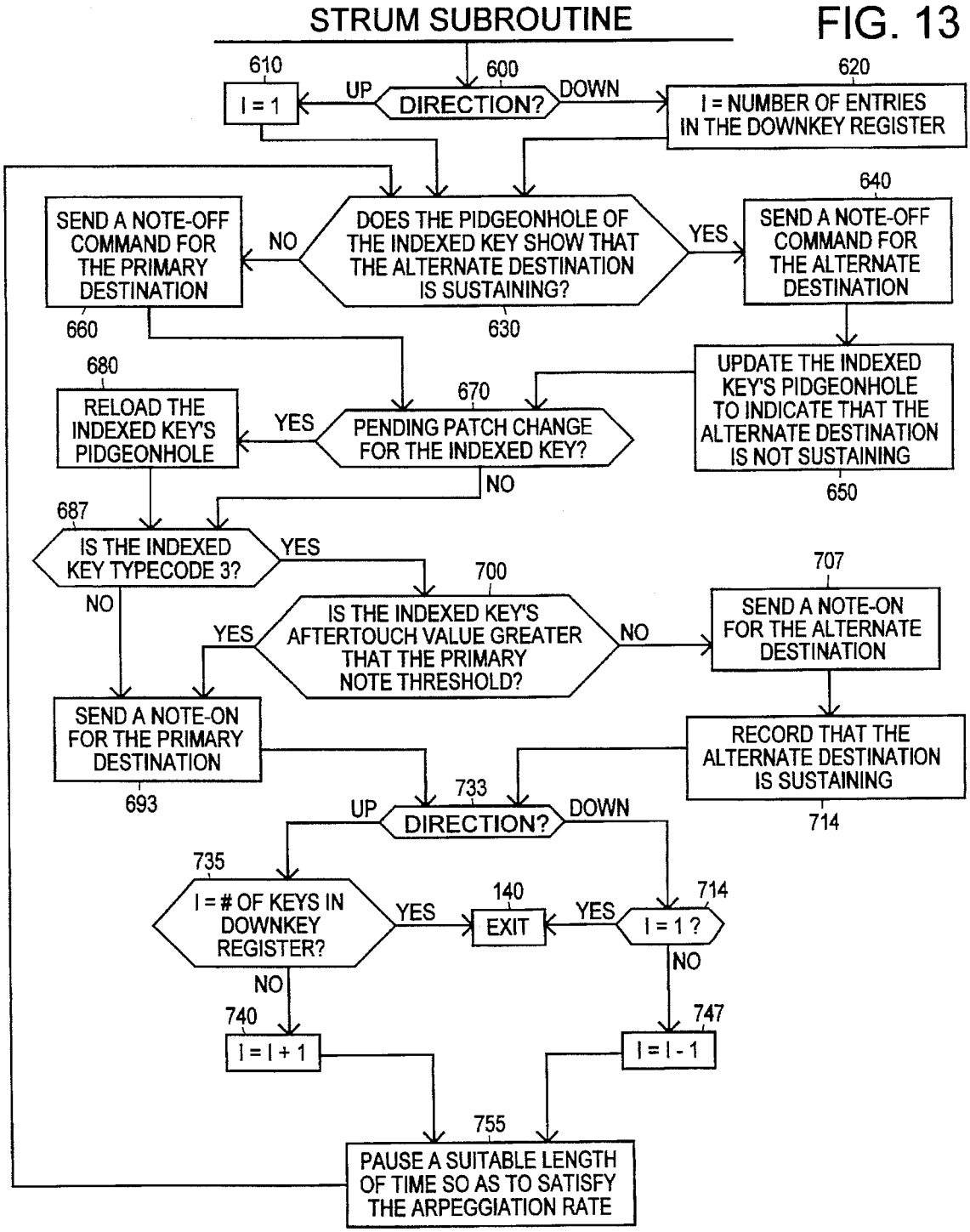
STRUM SUBROUTINE
FIG. 13
610
I = 1
UP
600
DIRECTION?
DOWN
620
I = NUMBER OF ENTRIES IN THE DOWNKEY REGISTER
SEND A NOTE-OFF COMMAND FOR THE PRIMARY DESTINATION
NO
DOES THE PIDGEONHOLE OF THE INDEXED KEY SHOW THAT THE ALTERNATE DESTINATION IS SUSTAINING?
YES
640
SEND A NOTE-OFF COMMAND FOR THE ALTERNATE DESTINATION
660
630
680
RELOAD THE INDEXED KEY'S PIDGEONHOLE
YES
670
PENDING PATCH CHANGE FOR THE INDEXED KEY?
UPDATE THE INDEXED KEY'S PIDGEONHOLE TO INDICATE THAT THE ALTERNATE DESTINATION IS NOT SUSTAINING
NO
650
687
IS THE INDEXED KEY TYPECODE 3?
YES
700
IS THE INDEXED KEY'S AFTERTOUCH VALUE GREATER THAT THE PRIMARY NOTE THRESHOLD?
NO
707
SEND A NOTE-ON FOR THE ALTERNATE DESTINATION
NO
YES
SEND A NOTE-ON FOR THE PRIMARY DESTINATION
693
RECORD THAT THE ALTERNATE DESTINATION IS SUSTAINING
714
733
UP
DIRECTION?
DOWN
735
I = # OF KEYS IN DOWNKEY REGISTER?
YES
140
EXIT
YES
714
I = 1 ?
NO
NO
740
I = I + 1
747
I = I - 1
755
PAUSE A SUITABLE LENGTH OF TIME SO AS TO SATISFY THE ARPEGGIATION RATE

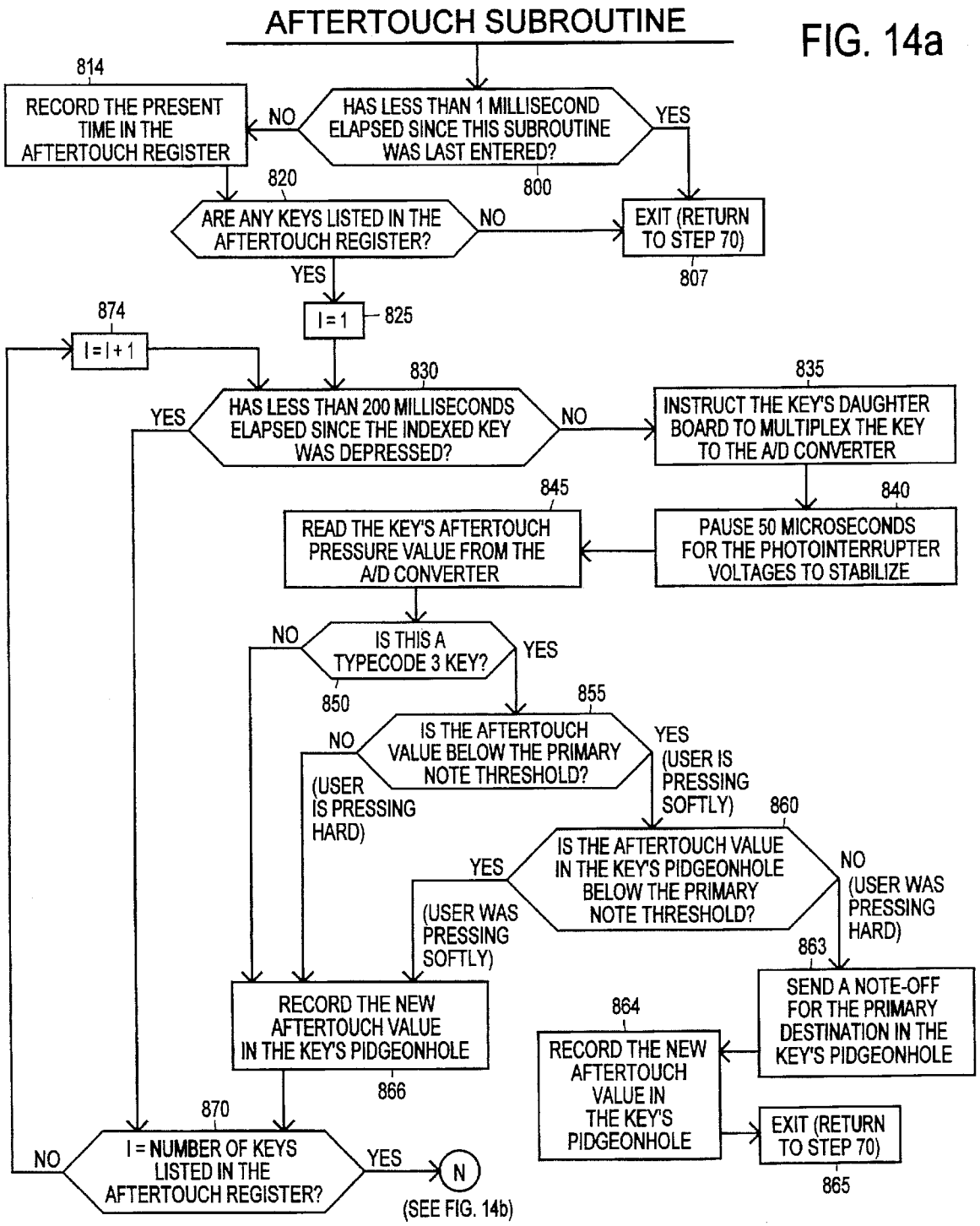
AFTERTOUCH SUBROUTINE
FIG. 14a
HAS LESS THAN 1 MILLISECOND ELAPSED SINCE THIS SUBROUTINE WAS LAST ENTERED?
800
NO
YES
814
RECORD THE PRESENT TIME IN THE AFTERTOUCH REGISTER
820
ARE ANY KEYS LISTED IN THE AFTERTOUCH REGISTER?
NO
EXIT (RETURN TO STEP 70)
807
YES
I = 1
825
874
I = I + 1
830
HAS LESS THAN 200 MILLISECONDS ELAPSED SINCE THE INDEXED KEY WAS DEPRESSED?
YES
NO
835
INSTRUCT THE KEY'S DAUGHTER BOARD TO MULTIPLEX THE KEY TO THE A/D CONVERTER
840
PAUSE 50 MICROSECONDS FOR THE PHOTOINTERRUPTER VOLTAGES TO STABILIZE
845
READ THE KEY'S AFTERTOUCH PRESSURE VALUE FROM THE A/D CONVERTER
IS THIS A TYPECODE 3 KEY?
850
NO
YES
855
IS THE AFTERTOUCH VALUE BELOW THE PRIMARY NOTE THRESHOLD?
NO
(USER IS PRESSING HARD)
YES
(USER IS PRESSING SOFTLY)
860
IS THE AFTERTOUCH VALUE IN THE KEY'S PIDGEONHOLE BELOW THE PRIMARY NOTE THRESHOLD?
YES
(USER WAS PRESSING SOFTLY)
NO
(USER WAS PRESSING HARD)
863
SEND A NOTE-OFF FOR THE PRIMARY DESTINATION IN THE KEY'S PIDGEONHOLE
864
RECORD THE NEW AFTERTOUCH VALUE IN THE KEY'S PIDGEONHOLE
EXIT (RETURN TO STEP 70)
865
RECORD THE NEW AFTERTOUCH VALUE IN THE KEY'S PIDGEONHOLE
866
870
I = NUMBER OF KEYS LISTED IN THE AFTERTOUCH REGISTER?
NO
YES
N
(SEE FIG. 14b)

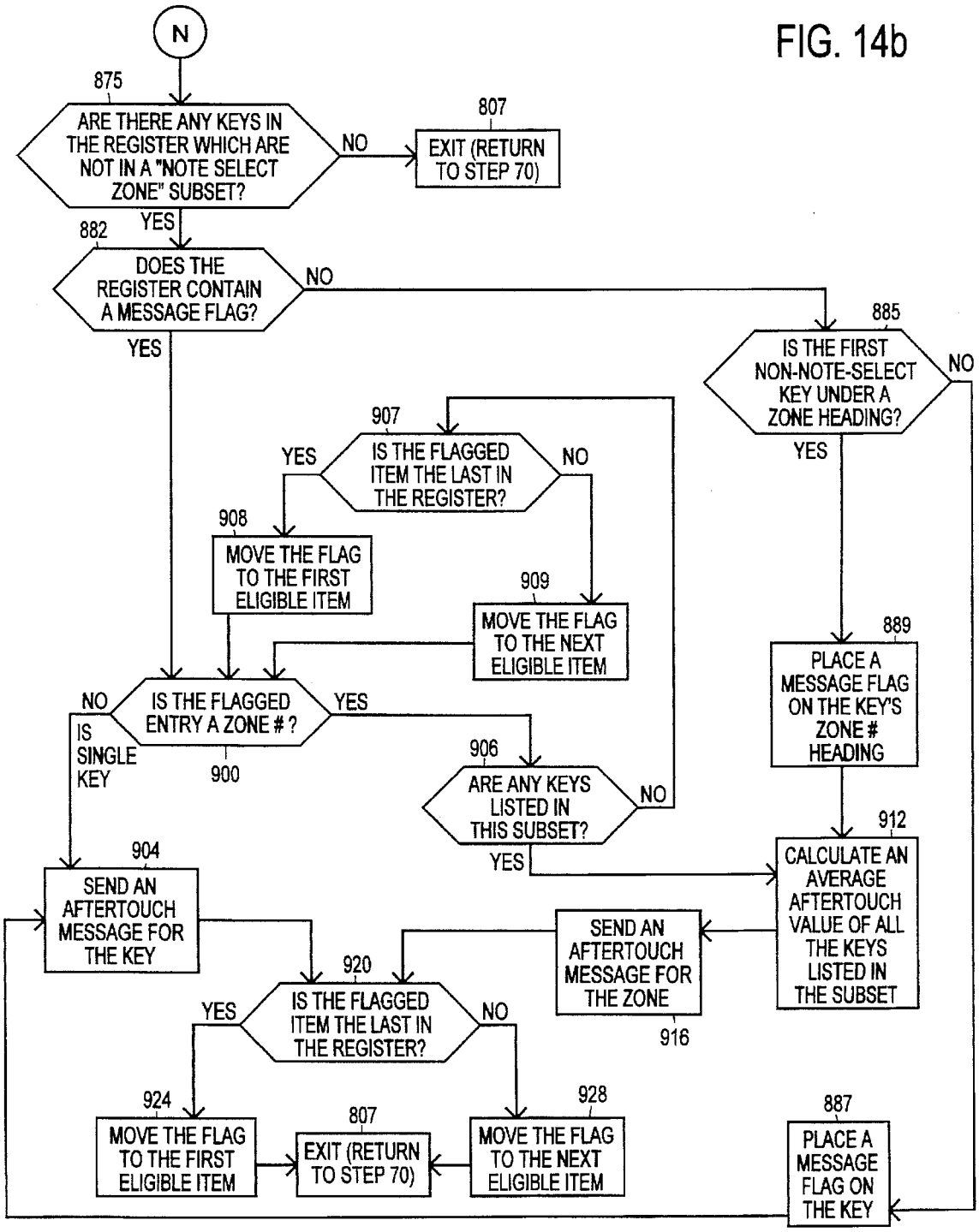
FIG. 14b
N
875
ARE THERE ANY KEYS IN THE REGISTER WHICH ARE NOT IN A "NOTE SELECT ZONE" SUBSET?
NO
807
EXIT (RETURN TO STEP 70)
YES
882
DOES THE REGISTER CONTAIN A MESSAGE FLAG?
NO
YES
885
IS THE FIRST NON-NOTE-SELECT KEY UNDER A ZONE HEADING?
NO
YES
907
IS THE FLAGGED ITEM THE LAST IN THE REGISTER?
YES
NO
908
MOVE THE FLAG TO THE FIRST ELIGIBLE ITEM
909
MOVE THE FLAG TO THE NEXT ELIGIBLE ITEM
889
PLACE A MESSAGE FLAG ON THE KEY'S ZONE # HEADING
NO
IS SINGLE KEY
IS THE FLAGGED ENTRY A ZONE # ?
YES
900
906
ARE ANY KEYS LISTED IN THIS SUBSET?
NO
YES
912
CALCULATE AN AVERAGE AFTERTOUCH VALUE OF ALL THE KEYS LISTED IN THE SUBSET
904
SEND AN AFTERTOUCH MESSAGE FOR THE KEY
SEND AN AFTERTOUCH MESSAGE FOR THE ZONE
916
920
IS THE FLAGGED ITEM THE LAST IN THE REGISTER?
YES
NO
924
MOVE THE FLAG TO THE FIRST ELIGIBLE ITEM
807
EXIT (RETURN TO STEP 70)
928
MOVE THE FLAG TO THE NEXT ELIGIBLE ITEM
887
PLACE A MESSAGE FLAG ON THE KEY

SYSTEM FOR TRIGGERING AND MUTING MUSICAL TONES EMPLOYING TWO OF MORE KEYBOARD KEYS WHICH OPERATE INTERACTIVELY

This application is a continuation-in-part of application Ser. No. 08/345,067 filed Nov. 22, 1994, now U.S. Pat. No. 5,505,115, for Keyboard Key Return and Motion Sensing Mechanisms Incorporating a Swing Arm; which is a continuation-in-part of Ser. No. 08/191,283 filed Feb. 3, 1994 for Keyboard Key Return and Motion Sensing Mechanism Incorporating a Swing Arm, abandoned; which is a continuation-in-part of application Ser. No. 08/040,209 filed Apr. 1, 1993, now U.S. Pat. No. 5,469,772, for Linearly Reciprocating Keyboard Key Incorporating Two Guide Pins.

FIELD OF THE INVENTION

This invention relates to a keyboard-controlled electronic musical instrument wherein keys of the, keyboard are grouped into sets. The keys within each set operate interactively to trigger and mute audio tones.

BACKGROUND OF THE INVENTION

One aspect of the Janko Keyboard (described in U.S. Pat. No. 360,255 and others) which constitutes an improvement over the conventional 7-5 keyboard is that the Janko provides a set of three keys for each note. This key duplication allows the musician to position his/her hand more comfortably and ergonomically. Another advantage of the Janko's key duplication is that a two-key note sustain function is provided: The performer may strike and hold a key on one row, hold another key of the same set (i.e., of the same note) with another finger of the same hand, release the first finger, and thus change hand position without muting the note. The same action may be carried out on a conventional keyboard, but often not as comfortably, since the depth (along the Y or front-rear axis) of the front portion of a standard white key is less than the distance between two Janko keys of the same set.

On a standard Janko Keyboard, keys of the same set move together. As noted in the present applicant's copending application Ser. No. 08/040,209, (now U.S. Pat. No. 5,469,772) various advantages are realized when all keys of the keyboard move independently. However, this raises the following question: If all keys move independently, how does one engineer a key sensing/tone generating system which features the advantages of independent key movement, yet retains the note sustain function described above?

Barreto (in U.S. Pat. No. 3,468,209, text column 2, line 50 thru text column 3, line 2) briefly describes two methods by which an independent-key Janko Keyboard may trigger tones. Whether the sustain function is retained by either of these methods is unclear; but one may presume that it is. However, regardless of whether the sustain function is retained, Barreto's key position sensing methods are very limited. They do not provide for velocity sensing or polyphonic aftertouch, nor do they provide the user with the option of disabling the sustain function, if desired. One reason the user may wish to disable the sustain function would be to produce fast repetitions of the same note. Barreto also does not provide a means by which keys of one set may trigger different tones.

To provide a keyboard musical instrument with keys grouped into sets wherein the sets can perform both sustain, repetition, polyphonic aftertouch, and other functions requires a departure from the prior art.

SUMMARY OF THE INVENTION

To achieve these objects, a polyphonic electronic musical instrument is provided. This musical instrument includes a keyboard with at least two key rows and at least 24 keys. This keyboard may be a conventional 7-5 keyboard, a Janko keyboard with independent keys, or another type of keyboard. For the purposes of this specification and appended claims, a standard two-manual organ is regarded as having two separate keyboards. A standard Janko Keyboard is regarded as a single keyboard with six rows.

The at least 24 keys of the keyboard are each independently-selectable. In other words, they each may be independently placed into a selected state. In the preferred embodiment, the keys move physically along a key axis of motion, and by physically moving a key from rest to depressed position, the user changes the state of the key from rest state to selected state. In any embodiment of the present invention, each key of the keyboard includes a key state sensor which inputs key state information to a signal processing system, e.g., a microprocessor-controlled computer system. At the very least, this information includes whether the key is in a rest or selected state. Many aspects of the invention may be realized with such a simple embodiment. It should be noted that in order for the user to alternate a key between rest and selected states, it is not necessary for the key to physically move. Various prior art keys consist simply of stationary plates of metal of other material which detect fingertip contact. While such a key cannot be "depressed" in the usual sense, such a key may be touched by a fingertip and thus placed into a selected state.

Each key's key state sensor may also detect velocity, precise key position, and aftertouch pressure, as will be seen subsequently.

The signal processing system processes key state information received from the keyboard and, following a predetermined software program, sends tone triggering/muting instructions to a tone-producing module. The keyboard, processing system, and tone-producing module may be housed within a single stand-alone unit, or separate units may be provided for each. For example, the invention may be realized through the use of a standard MIDI controller keyboard sending MIDI data to a stand-alone computer which then processes the received data according to the invention and sends this processed data via MIDI to a standard stand-alone tone producing module. In the preferred embodiment, the keyboard and microprocessor-controlled processing system are housed in a single unit and communicate via MIDI to a standard stand-alone tone producing module. The processing system and tone generating device may be incorporated into the same electronic device, circuit board, or even into the same microprocessor-driven computer system. Other hardware configurations are within the scope of the invention as well.

The at least 24 keys of the keyboard are grouped (via software in the processing system) into at least twelve key sets. Each key set includes at least two keys. The keys within each of these key sets occupy different key rows. Each key within a key set, when depressed, causes the processing system to command the tone-generating device to initiate production of a tone corresponding with that key at least when the other key(s) of the set are in rest position. Generally the tones corresponding with all the keys of any one set contain the same musical note, although this may not always be the case. The tones corresponding with all keys within the set may be identical, i.e., the keys within one set may correspond with the same tone (as on a conventional Janko Keyboard). Generally, it is envisioned by the inventor that keys of the same set will occupy the same position on the X axis (as on a Janko Keyboard), although the invention is not restricted to this configuration. With at least twelve key sets, at least one key set may be provided to correspond with each of the twelve tones of a conventionally-tuned octave.

The processing system is programmed in such a manner that, effectively, at most one tone corresponding with any of the key sets (according to the invention) will sustain at any one time. A key set may correspond with more than one tone (e.g., each key of the set may have a different corresponding tone), and there may be some temporal overlap as a new tone begins shortly before the prior tone mutes. However, this overlap, if it exists at all, is sufficiently brief that it is generally unnoticeable to the user. Thus, each key set produces substantially no more than one tone at a time. It should be noted that one "tone" may be created through the combination of two or more tones; e.g., two MIDI channel/note destinations may be triggered and muted simultaneously, creating one rich-sounding tone.

The processing system commands the tone generating device to initiate and terminate the tone(s) corresponding with a key set according to the invention without regard to whether keys within other same type key sets are depressed.

The invention includes four aspects.

The first aspect of the invention provides the sustain function described above. According to the first aspect of the invention, the processing system is programmed in such a manner that when any one key within any one of the key sets is depressed, the tone generating device receives a corresponding note on/velocity command only if the other keys of the set are in rest position at the time of depression. Once a tone has been thusly initiated, the processing system allows the tone generating device to continue production of the tone as long as at least any one key of the set is in depressed position. Thus, a first key may be depressed, initiating a first tone, a second key of the same set may be depressed as the first key is held down, and then the first key may be released without interruption or re-triggering of the first tone. A set of keys which operate interactively with each other in this manner are said to "sustain with" each other.

The second aspect of the invention provides the repetition function described above. According to this aspect, the processing system is programmed in such a manner that when any one key within any one of the key sets is selected, the tone generating device receives a corresponding note-on command regardless of whether the other keys of the set are in rest state at the time of selection. If a key of the set is in selected state as a new key of the same set is selected, a note-off command is sent corresponding with the first key. The note-off command may precede the note-on command, the note-on command may precede the note-off command, or the two commands may occur simultaneously. A set of keys which operate interactively with each other in this manner are said to "repeat with" each other.

The third aspect of the invention applies to both the sustain and repetition functions. According to this aspect, if two keys of the same set are held in depressed position and a tone corresponding with the set is sustaining, the processing system is programmed in such a manner that the tone will continue to sustain as long as either key remains in depressed position, even after one key is released. When the last remaining depressed key is released, the processing system instructs the tone generating device to terminate production of the tone.

The fourth aspect of the invention provides for an operating function select feature whereby the user may select between sustain, repetition, or perhaps other functions for the at least twelve key sets. This select feature is realized through a function selecting mechanism (e.g., a panel control switch) which provides a control input to the processing system.

BRIEF DESCRIPTION OF THE DRAWINGS

FIGS. 3–14 detail various program subroutines which are used in the preferred embodiment. Subroutines which require two drawing figures are split into two parts—a and b; for example, **14*a* and 14*b***.

ORIENTATION TERMS AND CLARIFICATIONS

In this specification and appended claims orientation terms are based on the orientation of a musician as most commonly positioned at a piano keyboard; thus:

The longitudinal axis is that which extends from the bass, or left end of the keyboard to the right, or treble end.

The lateral or transverse axis is that which extends from the front to the rear of the keyboard.

The vertical axis refers to the key axis of motion.

In this specification and appended claims, a statement that a key is "depressed" or "down" means that a key is moved from rest to depressed position. Depressed position does not necessarily refer to the absolute bottom end of key travel. Rather, this term refers to any depth of key depression which is beyond the threshold at which the key state sensing system interprets the key to be in depressed position. For example, this threshold may occur at ⅔ down from rest position. Likewise, rest position is any position above a predetermined rest position threshold; for example, the upper ⅓ of key travel. For example, an embodiment which is well within the scope of the 2nd aspect of the invention would be one in which when a first key is held down as a second key is depressed, the first tone is muted as the second key reaches ⅓ of its downward stroke, and the second tone is initiated when the second key reaches ⅔ of its downward stroke.

Key rows within a keyboard according to the present invention are not necessarily precisely parallel to the left-right keyboard axis. For example, a keyboard with angled rows (e.g., the Uniscala Keyboard shown in Keyboard magazine, June 1995) may be adapted to utilize the present invention.

Each claim appended to this specification refers to key sets which operate as described in that claim. This should not be taken to restrict the scope of the claims to a keyboard which contains only key sets which operate as described. For example, a keyboard according to the invention may simultaneously contain a plurality of key sets which operate in sustain mode (e.g., a bass keyboard zone), a plurality of key sets which operate in repetition mode (e.g., a treble keyboard zone), and also a plurality of key sets which operate in some manner completely foreign to the invention.

DESCRIPTION OF THE PREFERRED EMBODIMENT

I. Overview

The preferred embodiment of the invention is a five-row Janko controller keyboard with independent keys. Various embodiments of this keyboard are described in the applicant's prior patent, U.S. Pat. No. 5,185,490 (Key Guide) and pending applications Ser. No. 08/040,209 (Linearly Reciprocating Keyboard Key Incorporating Two Guide Pins, now U.S. Pat. No. 5,469,772), application Ser. No. 08/173,855 (Tactile Key Tops, now U.S. Pat. No. 5,515,763), and application Ser. No. 08/345,067 (Keyboard Key Return and Motion Sensing Mechanisms Incorporating a Swing Ann, now U.S. Pat. No. 5,505,115). These prior specifications are hereby incorporated by reference.

Figure 1:
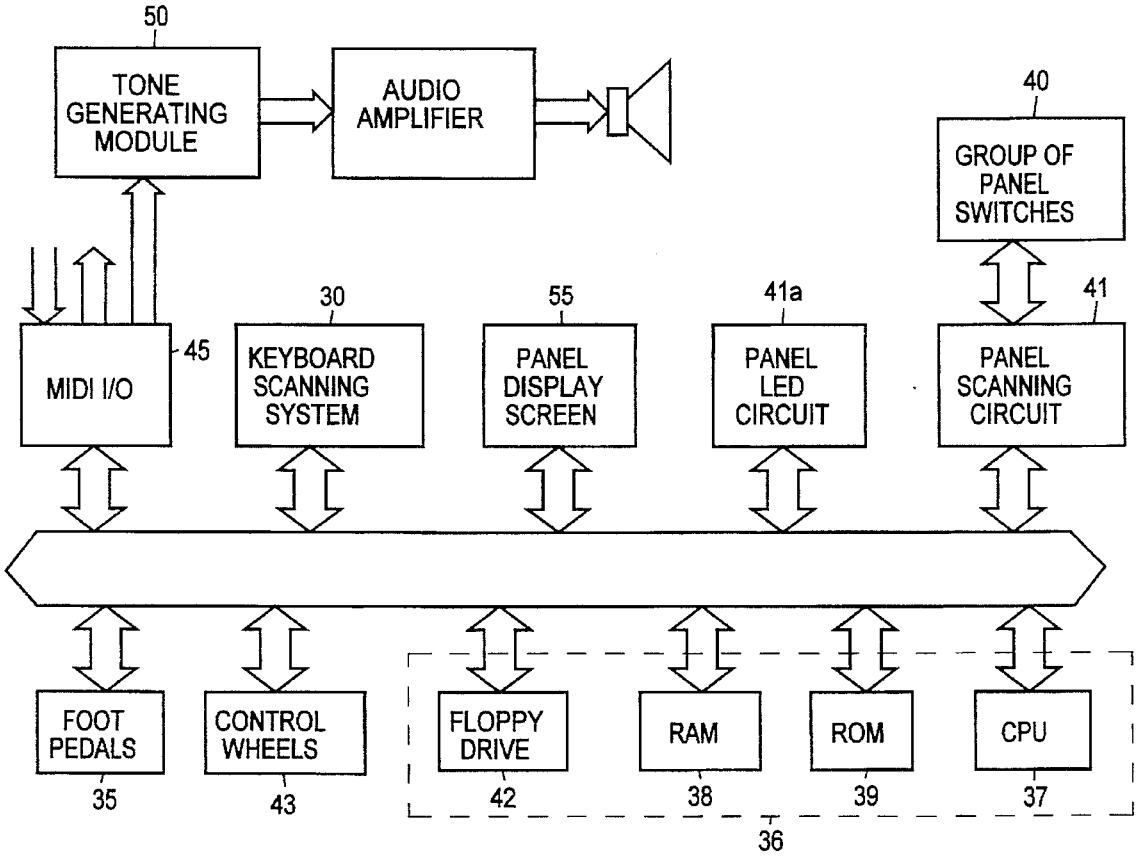
FIG. 1 shows a general overview of electronic systems/hardware which may be used to realize the invention.

With guidance from these prior specifications and the present specification, a person of ordinary skill in the art may engineer a keyboard with the necessary features to implement the present invention. Referring to FIG. 1, these features include:

(1) a keyboard 25 (A portion of a 5-level Janko keyboard is shown with an example of three keys which operate interactively as a key set 26, and an example of two keys which operate interactively as a key set 27.);

(2) a key state sensing system (including key position/velocity/pressure sensors 28 and a system to scan these sensors 30) which can, for each key of the keyboard 25, sense downward/upward velocity and at least 16 levels of aftertouch pressure;

(3) at least two foot pedals 35 each with sensors capable of measuring downward/upward pedal velocity (The pedal unit sold with the Ensoniq SDP-1 keyboard may be employed. This pedal includes two pedals each with a contact spring which alternates between upper and lower stationary contact wires. Transit time between these two contacts may be measured and pedal velocity may thus be calculated. Alternately, a pedal employing a photointerrupter sensor may be employed. Such a pedal may be monitored by one of the key sensing daughter microcontrollers shown in applicant's copending application Ser. No. 08/345,067 for Keyboard Key Return and Motion Sensing Mechanisms Incorporating a Swing Arm.);

(4) a microprocessor-controlled computer system 36 (including a central processing unit 37, a random-access memory 38, and a read-only memory 39) which can process information received from the key state sensors and other input devices;

(5) a control panel including various switches 40 to perform various control duties including (a) assisting in programming of the keyboard by the user, and (b) implementing control and configuration patch changes during performance;

(6) a panel scanning circuit 41 for reading control panel key state information;

(7) a panel LED circuit 41*a* for informing the user of which configuration patch is currently called up and for prompting the user during the programming process;

(8) a floppy-disk drive 42 or other transferrable memory storage media for loading the keyboard operating system and patches;

(9) at least two control wheels 43 for control of parameters such as MIDI channel pitch or modulation; and

(10) at least one data input/output port 45 which can transmit processed information to a sound-producing module via MIDI, ZIPI, or both. This processed information includes note-on/velocity commands, note-off/velocity commands, and aftertouch pressure. The MIDI standardized serial protocol is well-known within the industry. Information regarding the ZIPI protocol is available from CNMAT at the Dept. of Music, University of California, Berkeley. Besides operating a tone generating module 50, the MIDI/ZIPI port also serves to allow the keyboard to receive information during performance (such as, e.g., patch changes) from another source. A small microprocessor (not shown) may be provided, dedicated to the task of sending out MIDI and/or ZIPI data.

Several references are made in the following description to the MIDI standard protocol. These references are not intended to limit the preferred embodiment or the invention itself to MIDI. An electronic/software engineer of ordinary skill in the art possessing a working knowledge of MIDI and ZIPI should encounter no difficulty in translating the MIDI terms/elements following in this specification to ZIPI. The essence of the software shown in the drawing figures and described below may remain unchanged.

II. Summary of User-programmable Features and User-programming Process

After initialization, the keyboard defaults into play mode with configuration patch #1 called up. A patch (i.e., a configuration patch) is a pre-programmed configuration of key functions. The keyboard memory is capable of storing a plurality of patches for recall (one at a time) by the user. In play mode, patch changes may be implemented and the user is also presented with the option of entering Program Mode-a menu-driven process for programming or editing patches. The software program for this process is not central to the present invention, and thus will not be described in precise detail in this specification.

Upon entering Program Mode, the user is prompted via a panel display screen 55 to select a preexisting patch to edit or to start from scratch.

The user is then prompted to define a zone, if desired. A zone is defined as all the keys within a given width on the X (left-right) axis. Keys of the same set are always in the same zone. A zone may be as small as one key set or may include the entire keyboard. A Sub-zone is one row for a selected X-axis width. A Sub-zone may be as small as one key or as large as one key row.

Zones serve two functions: They speed the programming process by automatically assigning MIDI note/channel output destinations to the keys within based on user-selected parameters. If a zone is defined as being wider than one key, adjacent keys of the zone always have destinations one semitone apart in the same MIDI channel(s). The other function of zones is to define keys which repeat or sustain with each other.

The user may program a zone as one of 8 types:

1. Basic Sustain: Keys of the same set trigger the same notes and sustain with each other. This type of zone corresponds in function with a standard Janko Keyboard.

2. Sub-zones Sustain: Keys of the same set trigger different notes and sustain with each other.

3. Basic Repetition: Keys of the same set trigger the same notes and repeat with each other.

4. Sub-zones Repetition: Keys of the same set trigger different notes and repeat with each other.

5. Sub-zones Independent: All keys of the zone operate independently. Each key triggers one or more MIDI destinations simultaneously (i.e. depression of a key does not produce a "strum", or arpeggiation).

For each of the above five zone types, the user is prompted to select poly or mono aftertouch and to determine whether any of the pedals will perform functions effecting the zone such as sustain or sostenuto.

The keyboard also incorporates several "guitar modes" for simulating strummed guitar sounds. For these modes, three zone types are provided:

6. Single-Key Strumming-Strum Mode 5 (Strum Modes 1–4 will be discussed below): In Strum Mode 5, the top row keys default to do nothing. Patch change or other functions may be assigned to these keys later. For example, top row keys one tritone apart (e.g., all C's & F#'s in the entire row) may be assigned to strum click samples and the other top row keys may be assigned to change patches to select different chord types (e.g., major 7th).

Keys of the same set in rows 1 & 3 or 2 & 4 trigger "strums" (arpeggiations) of the same notes. Rows one & two produce downstrums (ascending arpeggiations). Rows three & four produce upstrums (descending arpeggiations). The reason the directions are reversed is that a guitar is generally tuned and positioned such that a downstrum produces an ascending arpeggiation of notes and an upstrum produces a descending arpeggiation.

The output velocities (generally output volumes) of the strummed notes are determined by the downward velocities of the keys; and the arpeggiation rate is determined by the elapsed time between successive key depressions. In this regard, Single Key Strumming operates like Strum Mode 3 discussed below.

When this type of zone is selected during the user-programming process, the user is prompted to select the strum destination notes (e.g., the six notes of the guitar chord) for each key set within the zone. For example, the two keys corresponding with middle C in rows 1 & 3 may be programmed to strum the standard open tuning of a C major chord on a guitar; the two adjacent keys corresponding with D may be programmed to strum the standard open tuning of a D major chord, and so on.

To avoid control logic problems, all keys within a Single-key Strumming zone repeat with each other. This function is implemented as follows: If a key is depressed as another key is held down and the previously depressed key is the partner of the new key, (i.e., if the old & new keys are in the same set and programmed to trigger the same notes) notes are muted one at a time, just prior to being re-struck. If the previously depressed key is another key of the same Single-Key-Strumming (SKS) zone, the notes corresponding with the old key are muted at once, just prior to the new strum.

If, during the programming process, some keys of the SKS zone (other than in row 5) are left undefined & without destination notes, the user is informed of this fact before exit.

No choice between poly or mono aftertouch in an SKS zone is offered to the user since only one key is active at one time; the question is therefore moot. Poly aftertouch is automatically selected. Poly aftertouch dam is sent to the sound module, which processes this dam according to its own programming. No Click+Tone feature (discussed below) is offered in Single-Key Strumming.

Two zone types are provided for manually selecting notes to be strummed in real time during performance in Strum Modes 1–4. Triggering of the notes selected in these zones is accomplished by movement of other keys (called "Strum Trigger Keys") on the keyboard which are discussed below. The two strum note select zone types are:

7. Single Note Select: Depression of a single key in this zone type selects a single note to be strummed. Generally, a typical user will depress a group of approx. four or five keys (forming a chord) at a time within a note select zone.

8. Click+Tone Select: A predetermined aftertouch threshold, referred to hereinafter as the "primary note threshold", is established for keys within this zone type. In this mode, each note select key toggles between two output note/MIDI channel destinations based on whether the key is depressed below or above this threshold. The two destinations are referred to as the "alternate" and "primary" destinations and are user-programmable. They may be different notes within the same channel, the same notes in different channels, or different notes in different channels. A recommended implementation has the low-pressure alternate destination corresponding with "click" sounds only, and the deeper (heavier-pressure) primary destination corresponding with the same "click" sounds plus sustaining tones. This implementation duplicates the left-hand strumming response on a guitar.

Zone types 7 or 8 may include sub-zones. One type of note-select sub-zone configuration which may be valuable to the user would be one in which the keys within two rows (within the zone) would be programmed to select notes one octave higher than their set partners. With this configuration, one hand may reach a wider musical interval. A chord stretched over this wider interval could perhaps more closely resemble a typical guitar chord voicing.

If either of the Basic zones or Note Select zones are selected, the user is prompted to define the destinations for the zone. If Sub-zones are selected, the user is prompted to define the destinations for row one, then row 2, etc. For a Note Select zone, after the destinations are defined, the user is prompted to select the strum trigger key(s) & one of Strum Modes 1–4. Keys may be programmed as doing nothing (by default). This option serves two functions:

1. It saves time in case the user desires no function for these keys (e.g., the user may wish to rest his/her hand on keys adjacent strum trigger keys); and 2. It leaves them open for use later use as patch control, strum trigger or independent control keys (functionally identical to Zone type 5 keys) without the user being prompted to confirm.

Just prior to recording a patch (exit), the user is asked whether any patch control keys are desired in the patch. If so, the user is asked to enter (1) the patch number to be called up, and (2) the key or foot pedal which will call up the patch. If any zones are programmed as Note Select, the user is also prompted to select the corresponding strum trigger key(s) (one at a time) and decide which trigger key type they will be. Double-key trigger key pairs (Single Key Strumming and modes 3 & 4 below) always operate as in repetition mode. Defining a key as a strum trigger key overrides the previous assignment for the key.

Just prior to exit the user is also given the opportunity to program individual keys which do not repeat or sustain with other keys (they may, however, sustain with the sustain pedal). These keys are identical in function to Zone type 5 keys and hereinafter will be regarded as Zone type 5 keys regardless of whether they were programmed as part of a type 5 zone or were programmed independently.

The user is then prompted to determine whether either of the control wheels will perform functions such as pitch or modulation, and on which MIDI channel. Upon exiting, the user is asked to select a patch number and title. If a patch already exists with that number, the user is prompted to confirm overwrite. The preexisting title defaults as the new title unless a new title is entered.

When a note select zone type 7 or 8 is defined, i.e., programmed, one or two corresponding strum trigger keys must also be defined (during programming mode) and used during performance to trigger strums of the notes selected in the note select zone.

The user may select one of four strum trigger key types:

Mode 1 (Single key or single foot pedal trigger):

Trigger key downstrokes trigger downstrums, or ascending arpeggiations. Trigger key upstrokes trigger upstrums, or descending arpeggiations. As mentioned above, the reason the directions are reversed is that a guitar is generally tuned and positioned such that a downstrum produces an ascending arpeggiation of notes and an upstrum produces a descending arpeggiation.

Elapsed time between trigger key down & up strokes determines arpeggiation rate (arpeggiation rate is the time between successive triggerings of notes within an up or down strum). The arpeggiation rate is proportional to the time between down & up strokes. Elapsed times greater than 400 milliseconds are interpreted as pauses between strums. The first arpeggiation rate of a performance is arbitrary and pre-programmed in the software.

Up/down stroke velocity of the trigger key (or foot pedal) determines output velocities (generally loudness) of selected strum notes. Thus, the same velocity value is sent to the sound module for all notes within a strum.

Muting of notes (note-off commands sent to sound module) are triggered by release of the note select keys (i.e., when the keys are raised above ⅓ from rest position). Release of individual keys trigger mutings of the corresponding notes; thus, notes may be muted individually and independently. In "note+click" mode, notes are muted when corresponding keys are lifted above the "click" aftertouch threshold.

Mode 2 (also single key or single foot pedal trigger):

As with mode 1, trigger key downstrokes trigger downstrums, or ascending arpeggiations; and trigger key upstrokes trigger upstrums, or descending arpeggiations.

Up/down stroke velocity of the trigger key (or foot pedal) determines arpeggiation rate. Faster trigger key velocities produce faster arpeggiation rates.

After-touch pressure of selected keys in the corresponding note-select zone determines output velocities. The user may program this pressure response as mono or poly-pressure:

In mono mode, the pressures of all selected keys within the note select zone are averaged when the trigger key (or pedal) is stroked; this average value is used to calculate a single output velocity which is assigned to all the selected notes for that stroke.

In poly mode, when the trigger key/pedal is stroked, the output velocity of each selected note is calculated independently based on the aftertouch value of its corresponding note select key.

The user is prompted to select between mono or poly mode when programming the trigger key.

If "note +click" mode is used, clicks (the user-defined destinations above the pre-determined aftertouch threshold) always have the same output velocity.

Muting of notes is processed as in Mode 1.

Mode 3 (double key or double foot pedal trigger):

Exactly two trigger keys (or foot pedals) are paired as in Sub-zones Repetition Mode; except that instead of simply triggering individual notes, the key/pedal pairs trigger strums of notes selected in the corresponding note select zone. One trigger key/pedal triggers an up-strum. The other triggers a down-strum.

Arpeggiation rate is determined as in Mode 1 except that all triggering key strokes are downstrokes. The occurrence time of trigger key upstrokes are not recorded, since elapsed times from trigger key upstrokes to other events (including other trigger key upstrokes) are not used to calculate anything. Upstrokes of either of the two trigger keys do not trigger strums and are processed as in Sub-zones Repetition Mode.

When at least one trigger key is held down, muting of notes is processed as in Mode 1. However, muting of all selected notes may be accomplished via release of both trigger keys. In other words, in order for a note to sustain, its corresponding note select key and at least one corresponding trigger key must be in depressed position.

Output velocities of selected notes are determined as in Mode 1 except that all triggering key strokes are downstrokes. In other words, output velocities are proportional to trigger key downstroke velocities.

Mode 4 (also double key or double foot pedal trigger):

Exactly two trigger keys/pedals are paired as in Mode 3. Down stroke velocities of trigger keys/pedals determine arpeggiation rates. Output velocities are determined as in Mode 2 (user selects mono or poly pressure sensing). Muting of notes is processed as in Mode 3.

No choice between poly or mono aftertouch for Mode 3 or 4 trigger keys is offered to the user since only one key is active at one time; the question is therefore moot. Poly aftertouch is automatically selected. Poly aftertouch data is sent to the sound module, which processes this data according to its own programming.

During the patch program process, the user always has the option of pressing a soft key (on the control panel) labeled "Check it Out" which implements the patch as written so far. To exit "Check it Out" mode, the user presses the same soft key again and resumes programming where he/she left off.

There are two other possible strum modes which may be incorporated for use with the invention. Flow charts for these modes are not provided in this specification. Nevertheless, a person of ordinary skill in the art may easily create flowcharts for these modes with guidance from this specification and drawing figures. The first of these two other possible strum modes is a combination of strum modes 1 and 2 in which elapsed time between down & up strokes of a single trigger key determines arpeggiation rate and aftertouch pressure of selected keys in the corresponding note-select zone determines output velocities. The second other strum mode is a combination of strum modes 3 and 4 in which elapsed time between down strokes of two trigger keys determines arpeggiation rate and aftertouch pressure of selected keys in the corresponding note-select zone determines output velocities.

III. Performance Operating Software

The preferred embodiment incorporates the key sensing system shown in FIG. 12 of copending U.S. patent application Ser. No. 08/345,067 (Keyboard Key Return and Motion Sensing Mechanisms Incorporating a Swing Arm). This key sensing system incorporates ten circuit boards, each sensing the states of 20 (or 19) keys. Each of these circuit boards includes a "daughter" microcontroller which sends key state information to a master microprocessor. This information includes key position (rest or depressed) and elapsed time as a key transits between ⅓ & ⅔ of key travel (when moving up or down). From this elapsed time the master processor can calculate key velocity. To sense aftertouch pressure of a depressed key, the master processor instructs that key's daughter controller to multiplex the key position sensor phototransistor output corresponding with that key to an analog/digital (A/D) bus. The master processor then performs an A/D conversion of the output.

A table of key states in RAM 38 is used to define key behaviors and to record the current state of the keyboard.

Each key and pedal has a corresponding data location or "pigeonhole" in the table. Each of these pigeonholes contains information regarding several parameters which define and record key behaviors. When a new and different configuration patch is loaded, at least some of the information in at least some of the pigeonholes is changed and the keys are thus redefined.

The following are types of key defining information which are loaded into the pigeonholes with patch changes:

1. What type of action occurs when a key is moved (which type of zone the key is contained within, whether the key is a strum trigger key, etc.). This information is stored as a number referring to a key "Typecode". Fifteen typecodes are discussed below.

2. Which MIDI channel/note destinations are associated with the key. A pigeonhole for a key of any of the eight zone types listed above includes a list of one to six MIDI note/channel destinations. The manner in which these destinations are triggered or muted depends on which type of action occurs when the key is moved. For example, a Basic Repetition key may have two destinations which will sound simultaneously when the key is struck. A Single Key Strumming (SKS) (Strum Mode 5) key will trigger up to six destinations in an arpeggiated sequence. The pigeonhole for an SKS key in row 1 or 2 includes a series of destinations arranged in an ascending sequence. The pigeonhole for an SKS key in row 3 or 4 includes a series of destinations arranged in a descending sequence. A key in a Note+Click note select zone (zone type 8) will trigger either of two destinations depending on whether the key is depressed beyond a given aftertouch threshold. The destination triggered when the aftertouch pressure being exerted on the key is above the threshold (typically a sustaining tone) is referred to as the "primary" destination. The destination triggered when the pressure is below the threshold (typically a "click" sound) is referred to as the "alternate" destination.

3. Whether one of the pedals serves as a sustain pedal for the key and if so, which one;

4. For keys in zone types 1–4, whether the key is one of a group of keys for which monophonic aftertouch data is to be sent, i.e., whether the key corresponds with one of the Aftertouch Register subsets described below;

5. For keys in zone types 1–4, which Set Register (see below) is associated with the key;

6. For keys in zone types 7 & 8, which Downkey Register (see below) is associated with the key;

7. For keys in zone type 6, which SKS Register (see below) is associated with the key;

8. For each Zone Type 6 key, each trigger key in Strum Mode 1, and each trigger key pair in Strum Mode 3, which "Longtime" data item (see below) corresponds with the key.

Each key pigeonhole also contains key state and key performance information which is updated as events occur. This information includes whether the key is in rest or depressed position, whether a patch change is pending, the velocity of the key's last stroke, when the last stroke occurred, and aftertouch pressure of the key. Also, a key in a Note+Click note select zone (zone type 8) may contain a notation that the alternate destination is currently sustaining.

The table of key states also includes a Set Register for each key set (in Zones 1–4) and for each trigger key pair in Strum Modes 3 & 4. This register includes an "A" data item, or "A" entry, which identifies a key of the set which has its corresponding destination sustaining; and a "B" data item which indicates that two keys of the set are in down position. The "A" data item contains a notation which indicates whether the destination is sustaining because a key of the set is depressed or because a corresponding sustain pedal is depressed. When two keys are programmed as strum triggering keys in modes 3 or 4 a Set Register is created for the two keys regardless of whether they are physically located at the same position on the X (left-right) axis of the keyboard. The Set Register for Mode 3 trigger keys pairs includes a "C" data item which includes a time of prior key depression to determine elapsed time between key strikings. Each Set Register also includes a notation specifying whether the keys contained in its set sustain or repeat with each other. This notation is loaded into the register when patch changes are implemented.

Each Zone type 5 key pigeonhole also contains an "A" data item which serves the same function as a set register "A" data item insofar as it indicates whether the key's destination is sustaining because a corresponding sustain pedal is down.

The table of key states also includes an SKS Register for each Single Key Strumming zone (Zone type 6; Strum Mode 5) which includes an "A" data item which identifies the key whose destinations are currently sustaining; a "B" data item which indicates that two keys within the zone are in depressed position; and a "C" data item which is used only to determine elapsed time between successive key strikings when an active key is depressed as no other keys of the zone are in depressed position. The "A" and "C" data items include a record of when the associated keys were struck (to determine elapsed time between strikings).

The table of key states also includes a Sustain Pedal Register which lists keys which have been sounded and released as the corresponding pedal is in depressed position.

The table of key states also includes a Downkey Register for each note select zone (zone type 7 or 8) which keeps track of which keys in the zone are depressed.

The table of key states also includes an Aftertouch Register which maintains a list of depressed keys for which it is desired that aftertouch pressure is to be measured. Depressed keys which are located within a zone for which the user has selected monophonic aftertouch are placed within a subset within the register headed by an ID number for the zone. Also included within each of these subsets is the destination (e.g., MIDI channel) for the zone's monophonic aftertouch data. The keyboard may, at one time (configured according to one patch), include several monophonic aftertouch zones and thus, several subsets within the Aftertouch Register. The register may also contain one or more subsets headed "Note Select", each of which includes depressed keys within a Note Select zone. Although aftertouch pressure is measured for these keys, no corresponding aftertouch message is sent to the sound module. Rather, the aftertouch values are used to determine whether Note+Click keys are below the "Click" threshold (for Zone 8 keys) and to determine output velocity (for Strum Modes 2 & 4). The monophonic zone subset headings and the Note Select Zone subset headings are entered into the Aftertouch Register when a patch is called and remain in the Register until a new patch is called, regardless of whether any keys are down. Also included in the Aftertouch Register is a record of when the Aftertouch Subroutine was last entered.

The table of key states also includes a data item called "Longtime" corresponding with each Zone Type 6 (Single Key Strumming, i.e., Strum Mode 5), each trigger key in Strum Mode 1, and each trigger key pair in Strum Mode 3. Elapsed time between triggering key movements are recorded in Longtime. When the configuration patch is first loaded, a predetermined value of 250 milliseconds (a typical average elapsed time between guitar strums) is automatically entered in Longtime. This value is continually updated as the user triggers strums more frequently than one per 400 Milliseconds.

The table of key states also includes a data item called "Newpatch" which contains the number of the patch most recently selected by the user.

Figure 2:
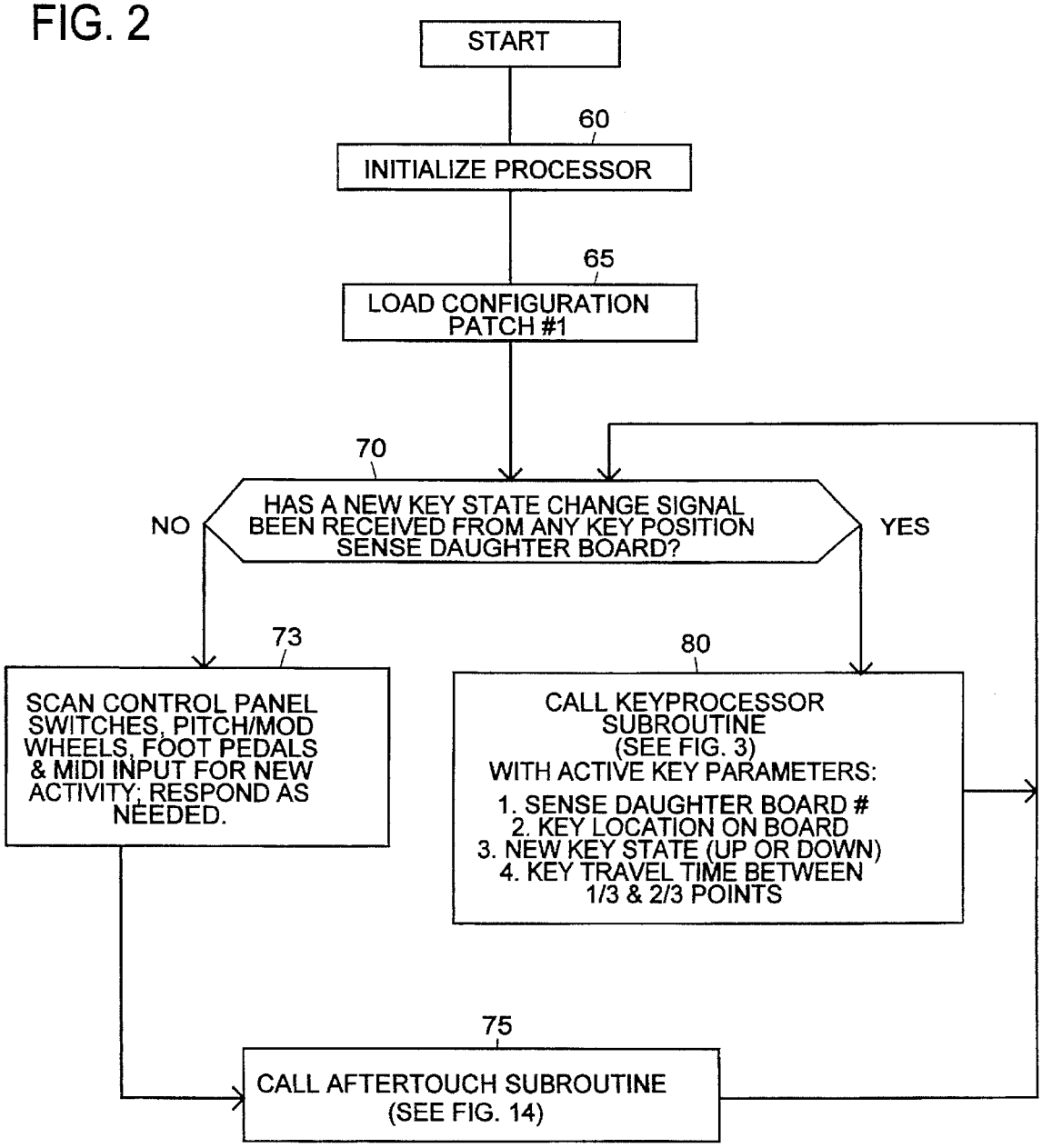
FIG. 2 shows an overview of the software program used in the preferred embodiment.

Referring now to FIG. 2 of the present specification, when the keyboard is first turned on the operating software program begins with an initialization process 60. This process includes loading the relevant contents of the floppy disk into RAM. These contents include the keyboard operating system and at least one configuration patch. The internal time clock is set to zero and begins an ascending count. This clock measures time in very precise units (e.g. one microsecond) in bytes with a sufficient number of bits so that no turnover will occur during a typical performance. Thus, the time at which key movement events occur may be recorded with great precision and elapsed time between events may be precisely measured as well.

In the next step 65 patch #1 is then called up and the keys of the keyboard are configured to respond accordingly.

In the next step 70, the master processor checks whether a new key state change signal has been received from one of the daughter key sense circuit boards. If not, the control panel switches 40 (see FIG. 1), pitch/mod wheels 43, foot pedals 35, & MIDI input port(s) 45 are scanned for new activity in step 73. Where new activity is found, the CPU responds accordingly. The aftertouch subroutine is then performed in step 75. Step 70 is then returned to. If a new key state signal is received, the Keyprocessor Subroutine 80 is again performed.

Figure 3:
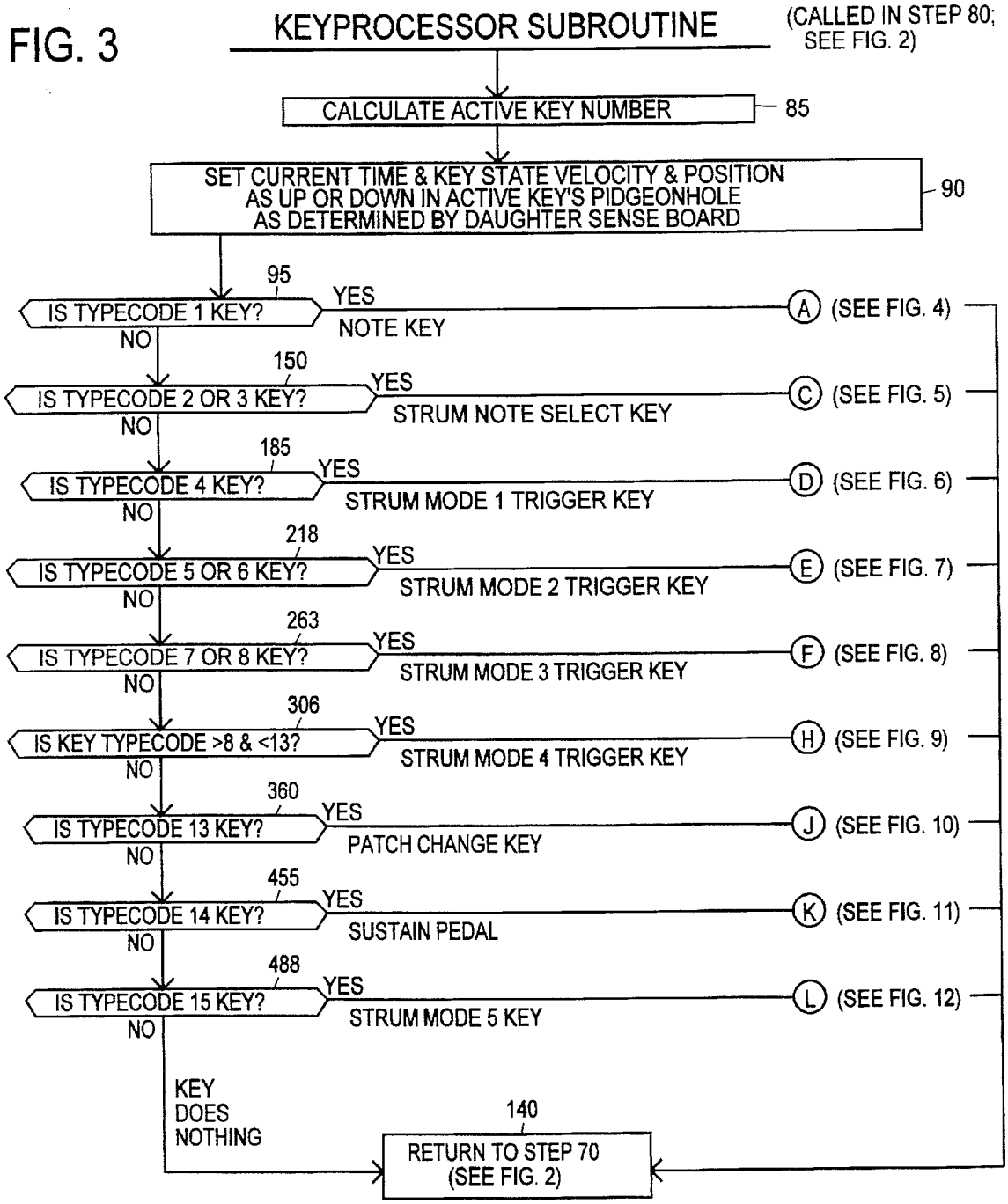

Referring now to FIG. 3 of the present specification, the Keyprocessor Subroutine first calculates the number of the active key as the number of the key's daughter sense board times the maximum number of keys on the sense board (e.g., 19) plus the key's location on the board (e.g., 5th key from the left) in step 85. The new position of the active key (up or down), the velocity of the key's last stroke (calculated as an inverse function of transit time between ⅓ & ⅔ points), and the time this stroke occurred are then entered into the key's pigeonhole in step 90. The pigeonhole includes a two-position shift register for recording stroke occurrence time. The most recent stroke time is recorded in the first position, and the prior stroke time is recorded in the second position. Time of prior stroke is required to carry out step 190 (see FIG. 6). If and when a note-on command is sent for the destinations listed in the pigeonhole, the velocity component of this command is taken from the velocity value in the pigeonhole which was recorded in step 90. The subroutine then determines the Typecode of the active key and calls the corresponding subroutine.

Figure 4A:
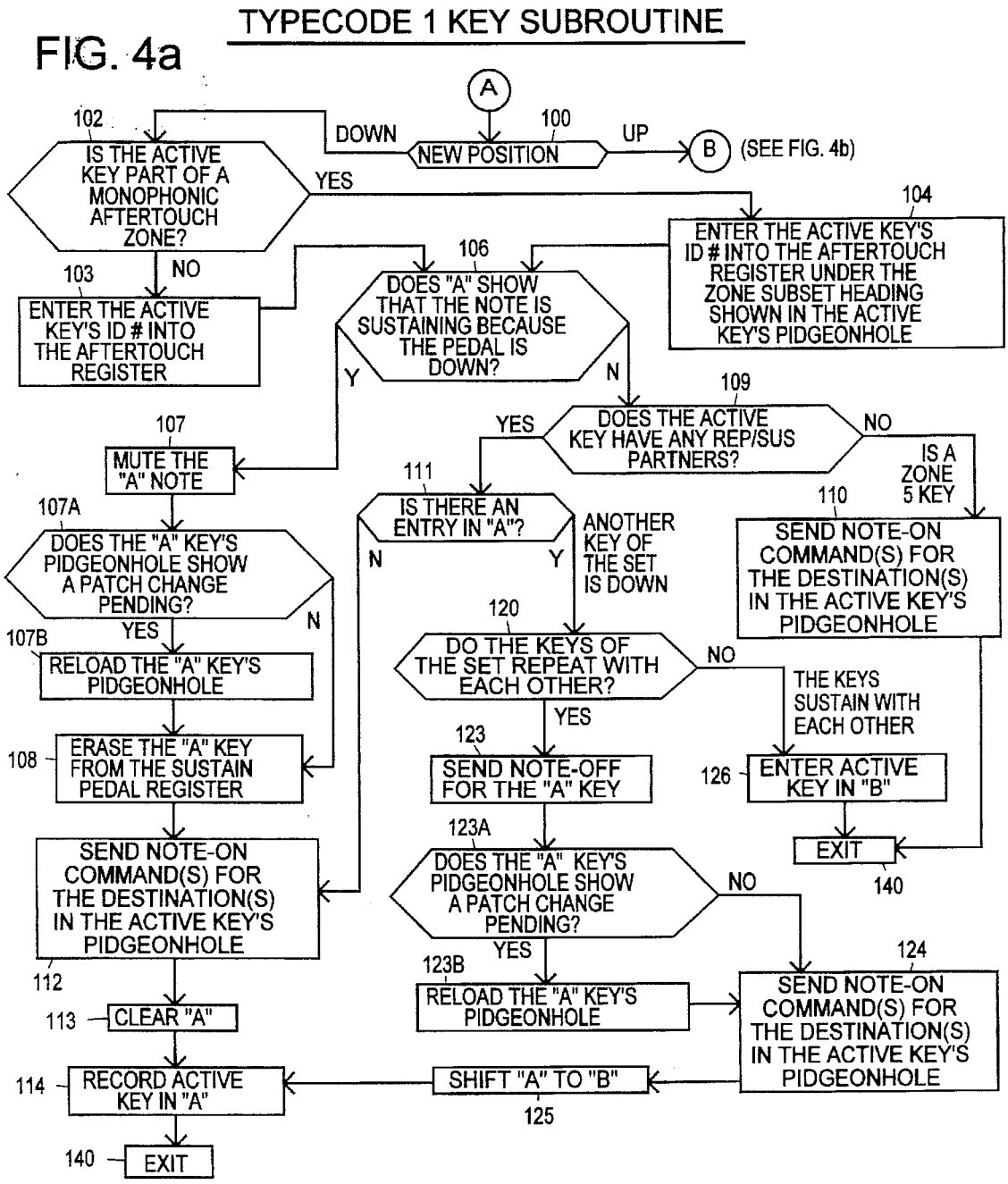

If the active key is in a Zone #1–5 and not programmed as a patch change or strum trigger key, then that key is a Typecode 1 key. The Typecode 1 Subroutine is called in step 95 and is shown in FIG. 4. In the first step 100, the subroutine determines whether the active key has just moved down or up based on the signal received from the daughter sense circuit board. If the new position is down (depressed) the active key's pigeonhole is checked in step 102 to determine whether the key is part of a monophonic aftertouch zone. If not, the key's ID number is entered into the Aftertouch Register in its own independent category in step 103 so that polyphonic aftertouch data may be sent for the key at a future time. If the active key is part of a monophonic aftertouch zone, the key's ID number is entered into the Aftertouch Register as part of a subset under the heading of the zone ID number found in the key's pigeonhole in step 104. The next step 106 determines whether the "A" data item associated with the active key (in the corresponding Set Register if the key is a Zone type 1–4 key or in the key's pigeonhole if the key is a Zone type 5 key) includes a notation that a destination associated with the key is sustaining because a corresponding sustain pedal is down. If so, a note-off command is sent for that destination in step 107. This note-off command is sent because the same destination may be triggered again in step 112. The pigeonhole of the key shown in "A" is then checked for a notation that a patch change is pending in step 107A. If so, the pigeonhole is then cleared and reloaded according to the patch shown in "Newpatch" in step 107B. In step 107B and other "reload the pigeonhole" steps, e.g., 123B, 184, etc., the data item which notes that a patch change is pending is removed as the pigeonhole is cleared and reloaded. The "A" key is then erased from the Sustain Pedal Register in step 108. Thus, if the user releases the sustain pedal while holding the key, the note will not mute. The logic of this subroutine (see steps 133, 134, 135, 138, 132) is such that the Set Register shows that "A" is sustaining due to the sustain pedal only if no other keys of the set are down. If "A" shows that the pedal is not sustaining a corresponding destination, the pigeonhole for the active key is checked in step 109 to determine whether the key repeats or sustains with any other keys. If it does not (e.g., if the key is a Sub-zones Independent Zone 5 key), then a note-on command is sent in the next step 110 to the destination(s) corresponding with the active key. The velocity component of this command is taken from the active key's pigeonhole as recorded in step 90. If the active key does have at least one rep/sus partner, the next step 111 checks the Set Register for the active key's set to see if there is a key number entered in the "A" position, i.e., to see if another key within the set is in depressed position. If not, a note-on command is sent for the active key in step 112. The "A" data item is then cleared in step 113 and the identity of the active key is recorded in "A" in the next step 114.

If the active key does have a partner in depressed position, the next step 120 consults the active key's Set Register to determine whether the keys of the register repeat or sustain with each other. If they repeat, a note-off command is sent for the sustaining note (destination in the pigeonhole of the "A" key) in step 123. The pigeonhole of the key shown in "A" is then checked for a notation that a patch change is pending in step 123A. If so, the pigeonhole is then cleared and reloaded according to the patch shown in "Newpatch" in step 123B. A note-on command is then sent for the active key in step 124. In the next step 125 the key ID number from the "A" data item is moved to the "B" data item. The active key number is then placed in "A" in step 114. If it is determined in step 120 that the set of keys sustain with each other, an entry is placed in "B" in step 126.

Figure 4B:
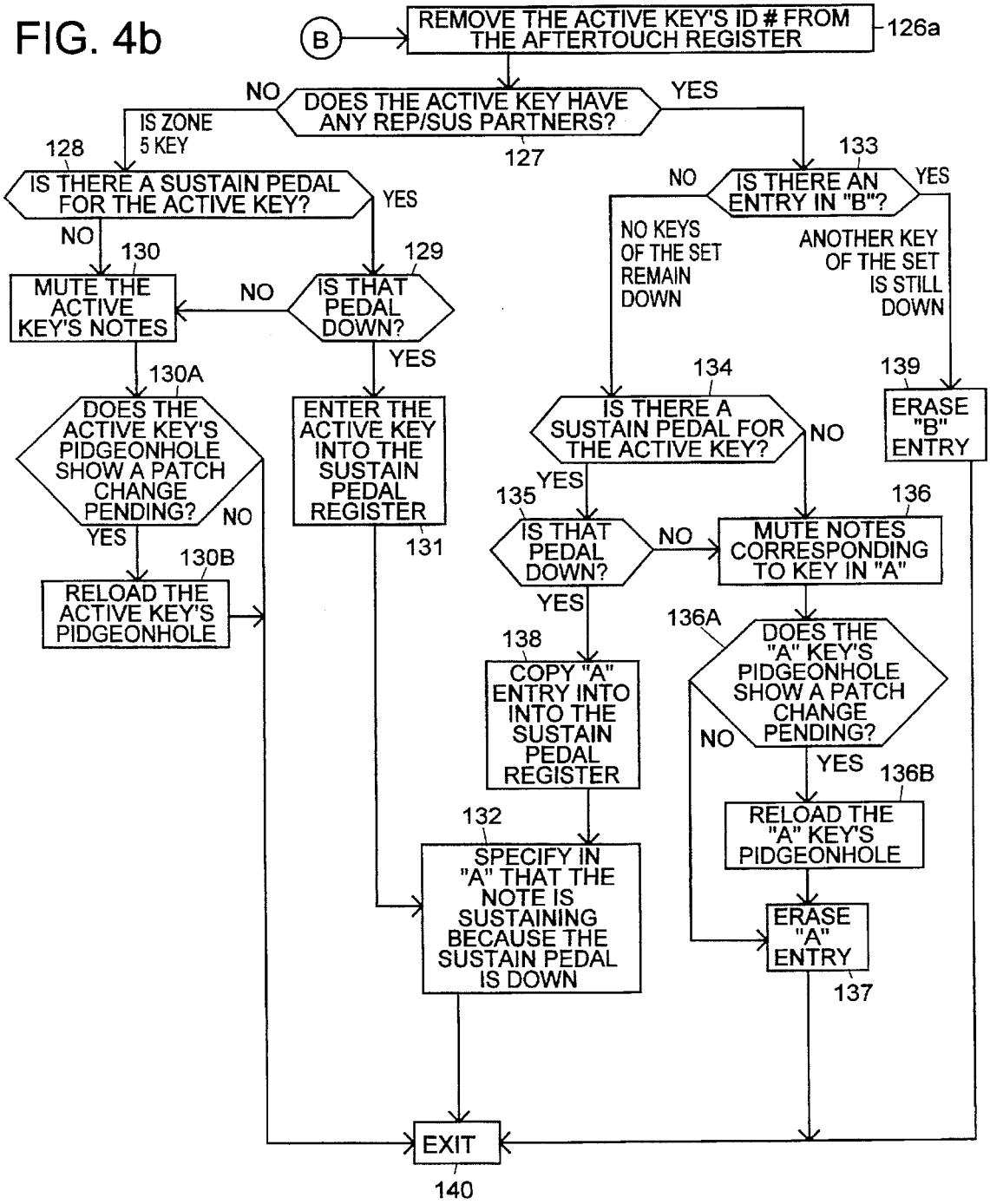

Referring now to FIG. 4*b*, if the new position of the active key is up, the active key's ID number is removed from the Aftertouch Register in step 126A. The next step 127 determines whether the active key repeats or sustains with any other keys. If not, it is determined in step 128 whether the active key has a corresponding sustain pedal. If so, that pedal's pigeonhole is checked in step 129 to determine whether that pedal is down. If not, a note-off command is sent for the active key's destination(s) in step 130. The pigeonhole of the active key is then checked for a notation that a patch change is pending in step 130*a*. If so, the pigeonhole is then cleared and reloaded according to the patch shown in "Newpatch" in step 130*b*. If the pedal is down, the identity of the active key is entered in the sustain pedal's Register in step 131. An "A" notation is then made in the active key's pigeonhole to specify that the key's destination(s) are sustaining because the pedal is down in step 132.

If the active key does have one or more repetition/sustain partners, the "B" data item of the active key's set register is checked in step 133 to determine whether another key of the set is in depressed position. If not, the active key's pigeonhole is checked in step 134 to determine whether one of the pedals is programmed as a sustain pedal for the active key. If so, the pigeonhole for the corresponding pedal is checked to see whether the pedal is down in step 135. If there is no corresponding depressed pedal, a note-off command is sent for the note corresponding to the key in "A" in step 136. The pigeonhole of the key shown in "A" is then checked for a notation that a patch change is pending in step 136A. If so, the pigeonhole is then cleared and reloaded according to the patch shown in "Newpatch" in step 136B. The "A" data item is then cleared in step 137. If the pedal is down, the key number in the set register "A" position is copied into the sustain pedal register in step 138. A notation is then made in the active key's Set Register "A" data item to specify that the key's destination(s) are sustaining because the pedal is down in step 132. Referring back to step 133, if the "B" data item indicates that another key of the set is down, the "B" data item is cleared in step 139, and no note-off command is sent.

When the subroutine is exited in step 140, step 70 (see FIG. 2) is called once again.

Referring again to FIG. 3, if the active key is used to select notes to be strummed (zone 7 or 8) then that key is a Typecode 2 or 3 key. Single Note Select keys are Typecode 2; Click+Note select keys are Typecode 3. The Subroutine for these keys is called in step 150 and is shown in FIG. 5. In the first step 160 the new position of the active key is determined from information received from the daughter sense board. If the active key has just moved down, the identity of the active key is entered into the corresponding Downkey Register and into the Aftertouch Register in step 165. The keys recorded in the Downkey Register are organized in a sequence of ascending MIDI note numbers. If the active key has just been released, the active key is removed from the Downkey Register and from the Aftertouch Register in step 170. Then, in step 175, the Downkey Register is compacted so that the last key at the end of the register can be easily located. The active key's pigeonhole is then checked in step 176 to determine whether the alternate destination (typically a "click" sound) is sustaining. If the active key is a Typecode 2 key, then there is no alternate destination, and step 177 is called. If the active key is a Typecode 3 key without a notation that the alternate destination is sustaining, then step 177 is also called. In step 177, a note-off command is sent for the primary destination. If it is determined in step 176 that the key is a Typecode 3 key with its alternate destination sustaining, a note-off command is sent for the alternate destination corresponding with the active key in step 179. The notation indicating that the alternate destination is sustaining is then removed from the active key's pigeonhole in step 180. The pigeonhole of the active key is then checked for a notation that a patch change is pending in step 182. If so, the pigeonhole is then cleared and reloaded according to the patch shown in "Newpatch" in step 184.

Figure 6:
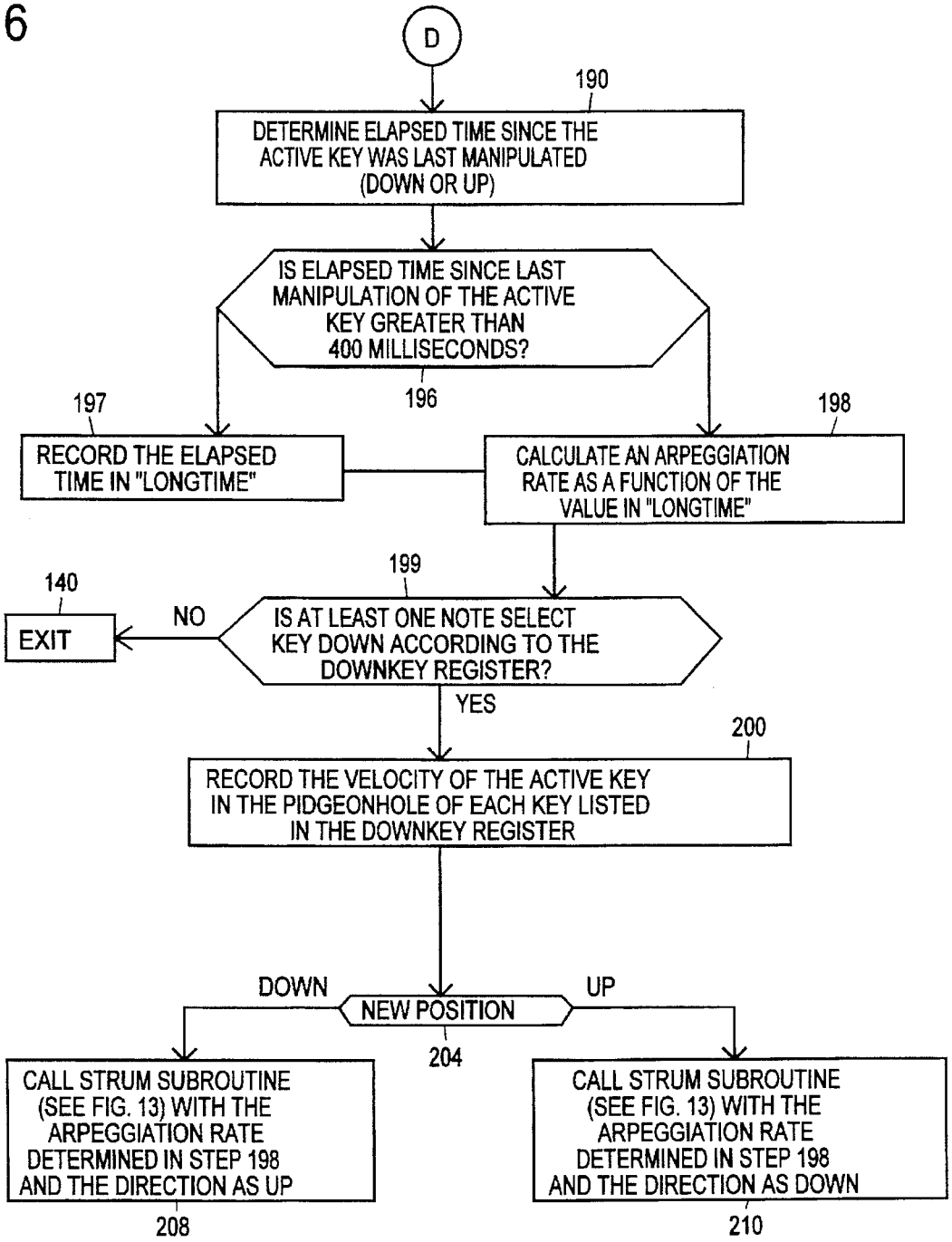

Referring again to FIG. 3, if the active key is used to trigger strums in Strum Mode 1, then that key is a Typecode 4 key. The Strum Mode 1 Triggering Key Subroutine is called in step 185 and is shown in FIG. 6. In the first step 190 the pigeonhole of the active key is checked to see when the key was last moved (from down to up or from up to down) and elapsed time from then to present is determined. Then, in step 196, it is determined whether the elapsed time since last movement is more than 400 milliseconds. In this strum mode, (and in Strum Mode 3 as well) pauses between trigger key movements of more than 400 milliseconds are interpreted as pauses between strums. If the elapsed time is less than 400 ms, then it is recorded in Longtime in step 197, erasing the previous Longtime value. An arpeggiation rate is then calculated in step 198 as a function of the "Longtime" value. In the next step 199 the Downkey Register of the corresponding note select zone is checked to determine whether any note select keys are in depressed position. If not, the subroutine is exited.

In an alternate embodiment, not shown, step 199 may be eliminated. Instead of having an empty Downkey Register when no note select keys are down, a predetermined list of six default destinations may be provided. Note-on commands sent to these destinations would produce "click" sounds. These predetermined "click" destinations would be removed, one at a time, as note select keys are depressed; and added, one at a time, as note select keys are released. Thus, movement of the trigger key when no note select keys are down would produce an arpeggiated series of click sounds (a "chucka" sound), as when a guitar player strums the strings with one hand while lightly touching the strings with his other hand. An advantage of this alternate embodiment is that the user would be able to completely lift his fingers from the note select keys and still be able to trigger a "chucka" sound with the trigger key. A primary note aftertouch threshold would be unnecessary. Thus, arm and finger fatigue may be reduced, since the user would not have to press hard on the note select keys to produce sustaining tones. The program steps to implement this function may be incorporated into the Note Select Key Subroutine. With a predetermined number of destinations (e.g., 6) always included in the Downkey Register, step 175 (see FIG. 5) could be eliminated.

Returning now to the shown embodiment, if it is determined in step 199 that at least one note select key is down, the velocity of the active key (an inverse function of elapsed time between ⅓ & ⅔ points) is then recorded in the pigeonhole of each key listed in the Downkey Register in step 200. In the next step 204 it is determined whether the active key has just moved up or down. If it is down, the Strum Subroutine is called in step 208 with the arpeggiation rate determined by the value in Longtime and the strum direction as up. If the active key has just moved up, the Strum Subroutine is called in step 210 with the arpeggiation rate determined by the value in Longtime and the strum direction as down.

Figure 7:
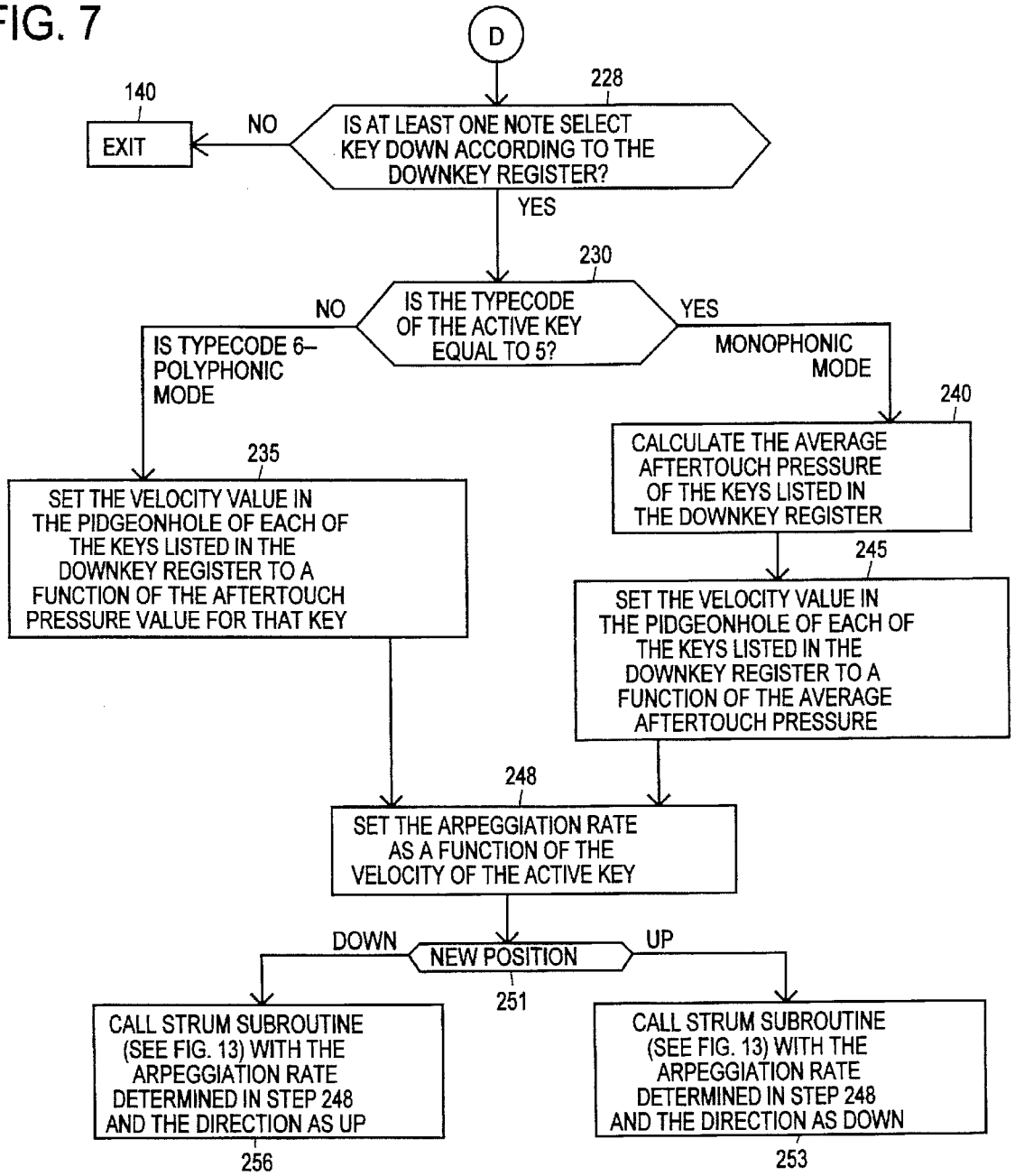

Referring again to FIG. 3, if the active key is used to trigger strums in Strum Mode 2, then that key is a Typecode 5 or 6 key. Typecode 5 keys trigger mono mode strums, i,e, output velocities are calculated based on averaged aftertouch pressure in the note select zone. Typecode 6 keys trigger poly mode strums. The Subroutine for these keys is called in step 218 and is shown in FIG. 7. In the first step 228 the Downkey Register of the corresponding note select zone is checked to determine whether any note select keys are in depressed position. If so, it is determined whether the active key is a Typecode 5 or 6 key in step 230. If it is a Typecode 6 key, the last recorded aftertouch value of each depressed note select key is used to determine the velocity value for that key in step 235. If the active key is a Typecode 5 key, the aftertouch pressure of the keys listed in the Downkey Register is averaged in step 240. This value is used to determine a single velocity value which is placed in the pigeonhole of each depressed note select key in step 245. An arpeggiation rate is then calculated based on the velocity of the active key in step 248. In the next step 251 the direction of the active key is determined. If the key just moved up, the Strum Subroutine is called in step 253 with the arpeggiation rate calculated in step 248 and the strum direction down. If the key just moved down, the Strum Subroutine is called in step 256 with the arpeggiation rate calculated in step 248 and the strum direction up.

Figure 8A:
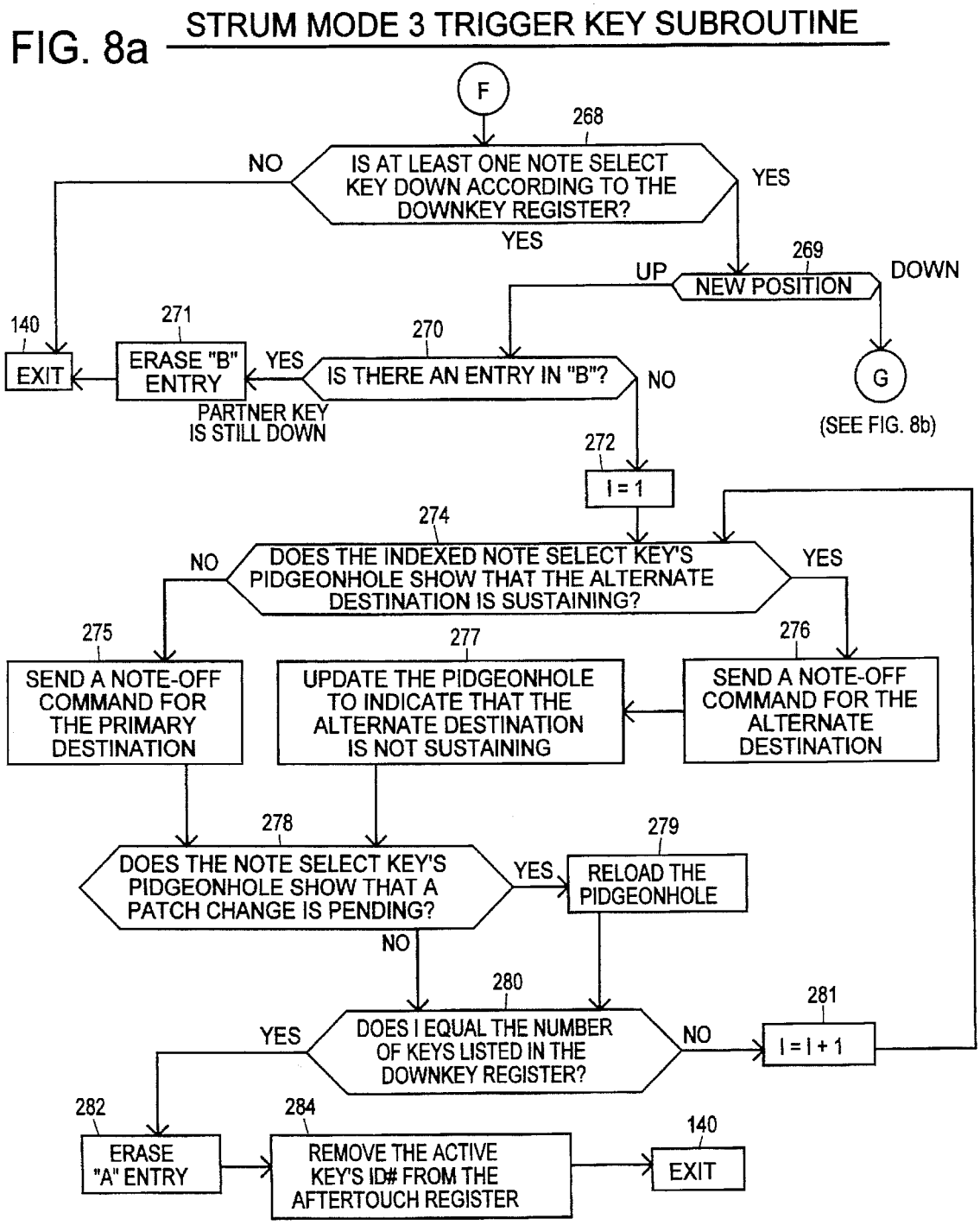

Referring again to FIG. 3, if the active key is one of a pair of keys used to trigger strums in Strum Mode 3, then that key is a Typecode 7 or 8 key. The Subroutine for these keys is called in step 263 and is shown in FIG. 8. In the first step 268 the Downkey Register of the corresponding note select zone is checked to determine whether any note select keys are in depressed position. If so, the new position of the active key is determined in step 269. If the active key just moved up, the Set Register for the two trigger keys is checked in step 270 to see if the active key's trigger partner is down. If so, the Set Register "B" data item is cleared in step 271 to indicate that only the partner key is still down. If the partner is up, an index number of one is established to index the first note select key listed in the Downkey Register. In step 274 the pigeonhole of the indexed key is checked to determine whether the key is a Typecode 3 with its alternate destination sustaining. If not, a note-off command is sent for the key's primary destination in step 275. If the key is a Typecode 3 with its alternate destination sustaining, then a note-off command is sent for the key's alternate destination in step 276. The notation indicating that the alternate destination is sustaining is then removed from the key's pigeonhole in step 277. The key's pigeonhole is then checked to determine whether a patch change is pending for the key in step 278 and, if so, the pigeonhole is reloaded according to the patch in "Newpatch" in step 279. It is then determined in step 280 whether steps 274 & 278 (and whichever of steps 275, 276, 277, & 279 are called for) have been performed for all keys in the Downkey Register. If not, the index number is increased by one in step 281 and step 274 is returned to. If so, the "A" data item of the Set Register is then cleared in step 282. The active key's ID number is then removed from the Aftertouch Register in step 284.

If the active key just moved down, the typecode of the key is determined in step 288 (see FIG. 8*b*). Typecode 7 keys trigger descending arpeggiations; Typecode 8 keys trigger ascending arpeggiations. Typecode 8 keys are positioned in rows one and two of the keyboard (nearest the user) and are generally depressed with the thumb; Typecode 7 keys are positioned in rows 3 and 4. The strum (arpeggiation) direction is set accordingly in step 290 or 291. In the next step 292 the velocity of the active key (elapsed time between ⅓ & ⅔ points) is recorded in the pigeonhole of each key listed in the Downkey Register. Then, in step 293, the existence of an "A" dam item in the Set Register is checked to determine whether the active key's trigger partner is down. If not, the active key and present time are recorded in "A" in step 294. The elapsed time between the time of the prior trigger key depression recorded in "C" and the present time recorded in "A" is then determined in step 295. If the partner key is down, the "A" data item including time of the prior trigger key depression is shifted to the "B" position in step 296. The active key and present time are then recorded in "A" in step 297. The elapsed time between the time of the prior trigger key depression recorded in "B" and the present time recorded in "A" is then determined in step 298. Then, in step 299, it is determined whether the elapsed time measured in step 295 or 298 is more than 400 milliseconds. If the elapsed time is less than 400 ms, then it is recorded in Longtime in step 300, erasing the previous Longtime value. An arpeggiation rate is then calculated in step 301 as a function of the "Longtime" value. The active key's ID # is then entered into the Aftertouch Register in step 302. In the next step 303, the Strum Subroutine is called with the arpeggiation rate and direction as determined above. This subroutine offers the user numerous performing options. For example, the user may strike the downstrum trigger key, producing a downstrum, and continue holding the key down while repeatedly striking the upstrum key. Since the downstrum key is being held down, the notes will not mute each time the upstrum key is released. With each up-down cycle of the upstrum key steps 276 and 296 are called. Thus, multiple upstrums may be performed without silent pauses in between. The arpeggiation rate is determined by elapsed time between successive strikings of the upstrum key.

Figure 9A:
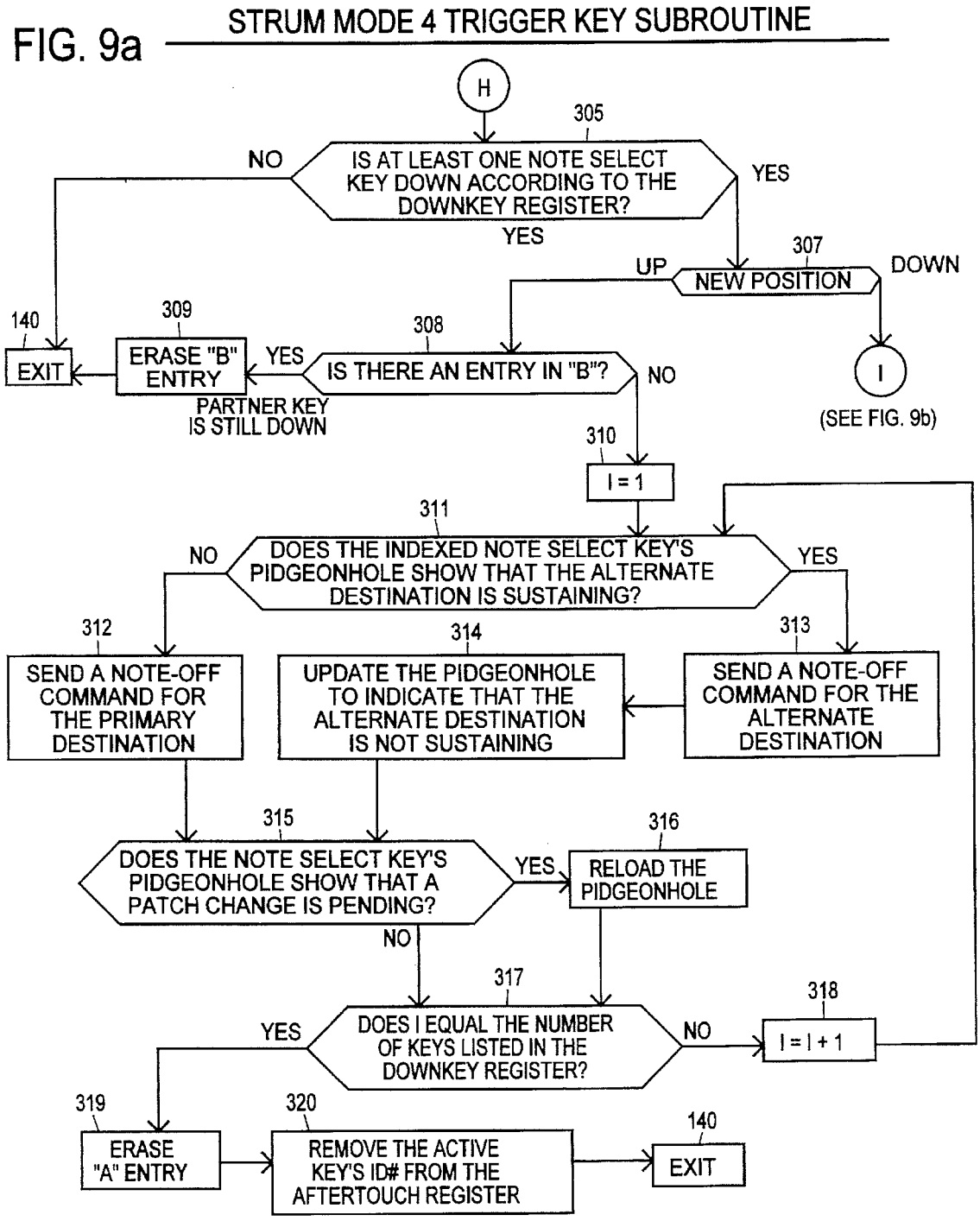

Referring again to FIG. 3, if the active key is one of a pair of keys used to trigger strums in Strum Mode 4, then that key is a Typecode 9, 10, 11 or 12 key. The Subroutine for these keys is called in step 306 and is shown in FIG. 9. In the first step 305 the Downkey Register of the corresponding note select zone is checked to determine whether any note select keys are in depressed position. If so, the new position of the active key is determined in step 307. If the active key just moved up, the Set Register for the two trigger keys is checked in step 308 to see if the active key's trigger partner is down. If so, the Set Register "B" data item is cleared in step 309 to indicate that only the partner key is still down. If the partner is up, an index number of one is established in step 310 to index the first key listed in the Downkey Register. Then, in step 311, the pigeonhole of the indexed key is checked to determine whether the key is a Typecode 3 with its alternate destination sustaining. If not, a note-off command is sent for the key's primary destination in step 312. If the key is a Typecode 3 with its alternate destination sustaining, then a note-off command is sent for the key's alternate destination in step 313. The notation indicating that the alternate destination is sustaining is then removed from the key's pigeonhole in step 314. The key's pigeonhole is then checked to determine whether a patch change is pending for the key in step 315 and, if so, the pigeonhole is reloaded according to the patch in "Newpatch" in step 316. It is then determined in step 317 whether steps 311 & 315 (and whichever of steps 312, 313,314, & 316 are called for) have been performed for all keys in the Downkey Register. If not, the index number is increased by one in step 318 and step 311 is returned to. If so, the "A" data item of the Set Register is then cleared in step 319. The active key's ID # is then removed from the Aftertouch Register in step 320.

Figure 9B:
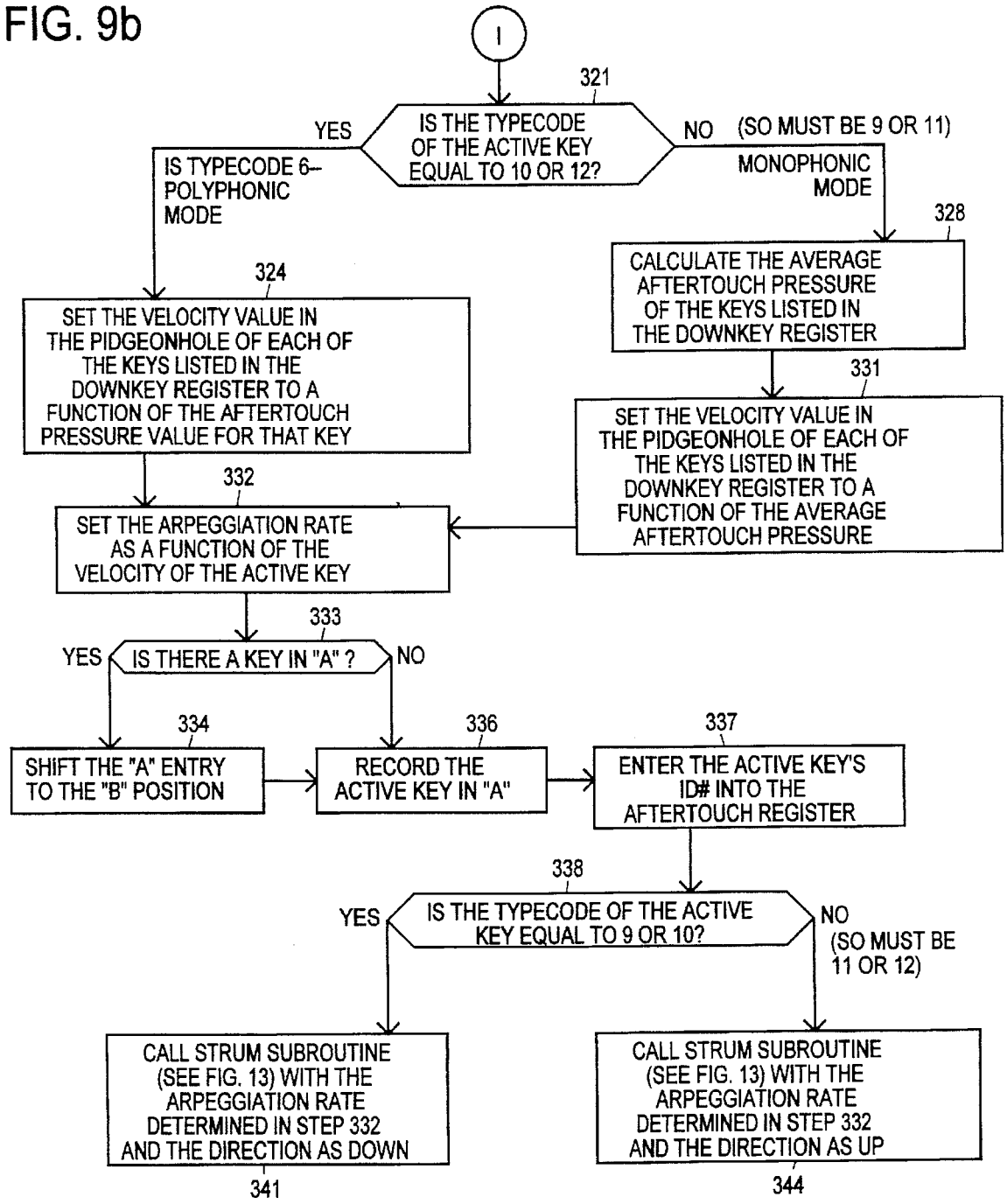
Figure 9B:
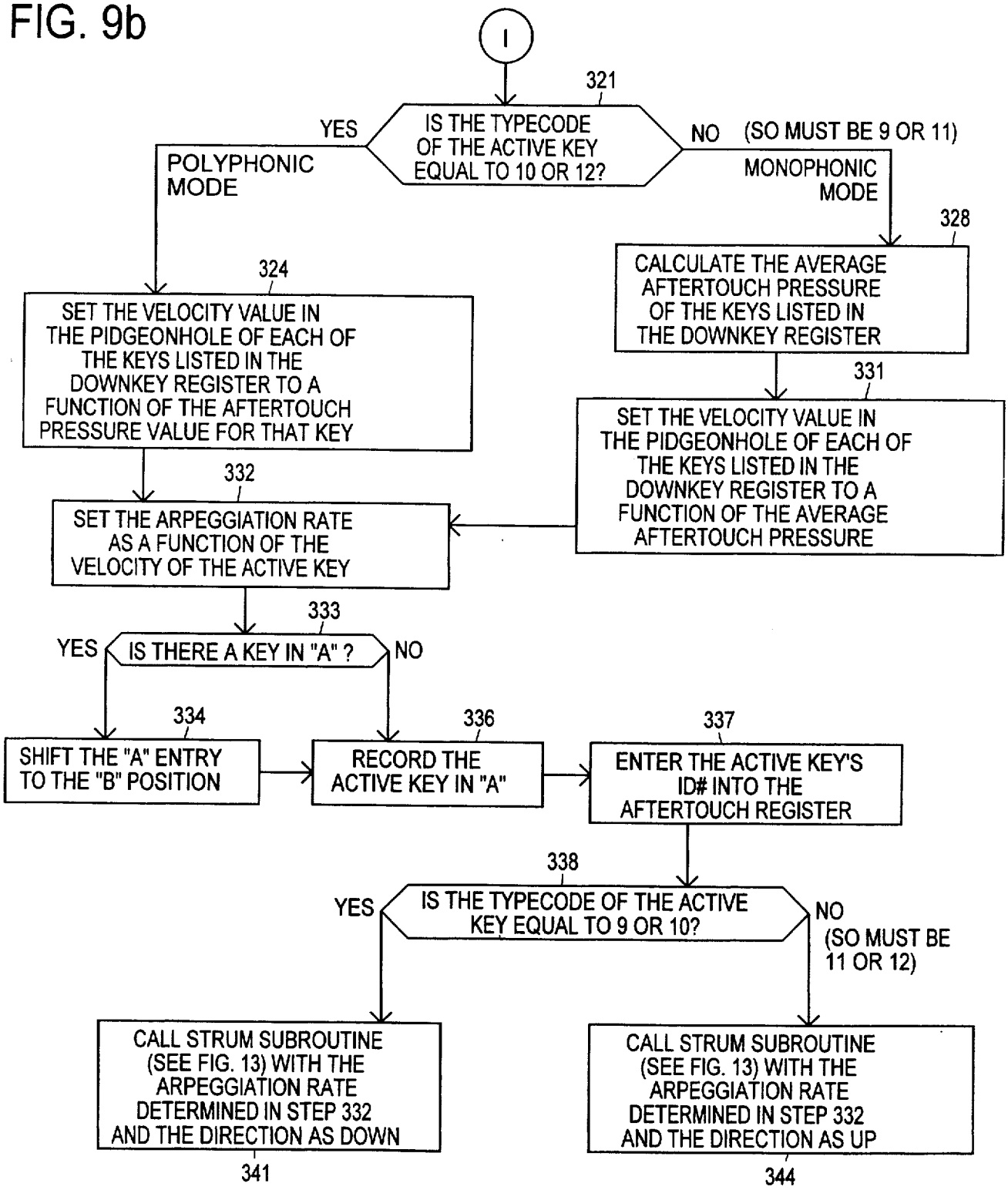

If the active key just moved down, it is determined whether the active key is one of Typecode 9 & 11 or one of Typecode 10 & 12 in step 321 (see FIG. 9*b*). Typecode 9 & 11 keys trigger mono mode strums, i.e, output velocities are calculated based on averaged aftertouch pressure in the note select zone. Typecode 10 & 12 keys trigger poly mode strums. If the active key is a poly key, the last recorded aftertouch value of each depressed note select key is used to determine the velocity value for that key in step 324. If the active key is a mono key, the aftertouch pressure of the keys listed in the Downkey Register is averaged in step 328. This value is used to determine a single velocity value which is placed in the pigeonhole of each depressed note select key in step 331. An arpeggiation rate is then calculated based on the velocity of the active key in step 332. In the next step 333, the Set Register corresponding with the active key is checked to determine whether the active key's partner is down. If so, the partner key is placed in the "B" position in the Set Register in step 334 to specify that both trigger keys are now down. The active key is then recorded in the "A" position in step 336. The active key's ID # is then entered into the Aftertouch Register in step 337. In the next step 338 it is determined whether the active key is one of Typecode 9 & 10 or one of Typecode 11 & 12. Typecode 9 & 10 keys trigger descending arpeggiations; Typecode 11 & 12 keys trigger ascending arpeggiations. If the key is a 9 or 10, the Strum Subroutine is called in step 341 with the arpeggiation rate calculated in step 332 and the arpeggiation direction down. If the key just moved down, the Strum Subroutine is called in step 344 with the arpeggiation rate calculated in step 332 and the arpeggiation direction up.

Referring again to FIG. 3, if the active key programmed to enact a patch change, then that key is a Typecode 13 key. The Patch Change Subroutine is called in step 360 and shown in FIG. 10. This same subroutine is called when a patch change is initiated by control panel keys in step 73 (see FIG. 2). In the first step 370 it is determined whether the active key has moved up or down. If the key has moved up, the subroutine is exited. If the key has moved down, the new patch number is entered into "newpatch" in step 375. In the next step 380 it is determined whether the present patch (the patch in use prior to the most recent depression of the active key) contains any Set Registers. If so, it is determined in step 385 whether any of the Set Registers contain an "A" data item, i.e., whether a note corresponding with that register is sounding. If so, a notation is made in the pigeonhole of each "A" key that a patch change is pending for that key in step 388.

In the next step 390 it is determined whether the present patch includes any SKS Registers, i.e., whether there are any Single Key Strumming (Strum Mode 5) keys. If so, it is determined in step 394 whether any of the SKS Registers contain any "A" data items, i.e., whether any Single Key Strumming: keys are down. If so, a notation is made in the pigeonhole of each "A" key that a patch change is pending for that key in step 399.

In the next step 400 it is determined whether the present patch includes a pedal which is assigned to a sustain function. If so, it is determined in step 405 whether that pedal is down. If so, a notation is made in the pedal's pigeonhole that a patch change is pending in step 407. A notation is then made in the pigeonhole of each key listed in the pedal 's register that a patch change is pending in step 408.

In the next step 411 it is determined whether the present patch includes any Downkey Registers, i.e., whether the present patch includes any note select zones. If so, the Downkey Register is checked in step 414 to determine whether any note select keys are down. If so, a notation is made in the pigeonhole of each key listed in the Downkey Register that a patch change is pending in step 418.

In the next step 422 it is determined whether the present patch includes any Typecode 1 keys which have no repetition or sustain partners, i.e., whether there are any Zone 5 keys. If so, the pigeonholes of these keys are checked in step 426 to determine whether any of these keys are down. If so, a notation is made in the pigeonhole of each of depressed Zone 5 key that a patch change is pending in step 429.

In the next step 433 the pigeonhole of each pedal and each key of the keyboard is checked to determine whether a patch change is pending for that key or pedal. For each key or pedal which does not have a patch change pending, the new key defining information for that key or pedal corresponding with the patch number shown in "Newpatch" is entered into the pigeonhole.

All zone headings in the Aftertouch Register as well as depressed key data items under these headings are then deleted from the Aftertouch Register in step 435. New zone headings are then created and entered into the Aftertouch Register in step 436. The corresponding destination (e.g., MIDI channel) for each mono aftertouch zone is entered also. Mono aftertouch zone headings receive eligibility flags; Note Select zone headings do not. These data items and flags are discussed below just prior to the explanation of step 875.

The control panel display 41a (see FIG. 1) is then updated in step 438 to show the new patch.

Referring again to FIG. 3, if the active key (or pedal) is programmed to serve a sustain pedal function, then that key is a Typecode 14 key. The Sustain Pedal Subroutine is called in step 455 and is shown in FIG. 11. In the first step 460 it is determined whether the key has moved down or up. If it has moved down, the subroutine is exited. The fact that the pedal is now down has already been recorded in the pedal's pigeonhole in step 90. If the key has moved up, an index number of one is established in step 463 indexing the first key listed in the corresponding Sustain Pedal Register. Then, in step 466, the "A" data item in the key's Set Register (for Zone 1–4 keys) or pigeonhole (for Zone 5 keys) is erased. In the case of Zone 5 keys, this erasure simply serves to erase the notation that the note is sustaining because the pedal is down (entered in step 132 from step 131). A note-off command is then sent for the destination listed in the key's pigeonhole in step 470. The key's pigeonhole is then checked to determine whether a patch change is pending in step 471 and, if so, the pigeonhole is reloaded according to the patch in "Newpatch" in step 472. It is then determined in step 473 whether steps 466, 470, & 471 (and step 472 if called for) have been performed for all keys in the Aftertouch Register. If not, the index number is increased by one in step 474 and step 466 is returned to. If so, the Register is then cleared in step 477. It is then determined in step 479 whether a patch change is pending for the sustain pedal. If so, the pedal's pigeonhole is reloaded in step 481.

In the interest of brevity, sustain pedal functions are not included in the Strum Modes subroutines. The steps relating to the sustain pedal shown in FIGS. 4 & 11 may easily be duplicated in the subroutines shown in FIGS. 5–9 & FIG. 12. Also, sustain pedal functions are not necessary in the Strum Modes subroutines.

Referring again to FIG. 3, if the active key is a Single Key Strumming (Strum Mode 5) key, then that key is a Typecode 15 key. The Subroutine for this keys is called in step 488 and is shown in FIG. 12. In the first step 494 the new position of the active key is determined. If the key just moved down, the corresponding SKS Register is checked in step 499 to determine whether there is a key shown in "A", and thus, whether another key in the active key's zone is currently down. If so, the pigeonhole of the "A" key is then checked in step 500 to determine whether a patch change is pending for that key. If so, note-off commands are sent for the destinations corresponding with the "A" key in step 501. The pigeonhole of the "A" key is then reloaded in step 502 according to the patch shown in "Newpatch". If it was determined in step 500 that there was no patch change pending for the "A" key, then it is then determined in step 504 whether the "A" key is in the same set as the active key. If two SKS keys trigger the same set of notes in different directions (one ascending, the other descending), then those two keys are in the same set. SKS keys of the same set occupy the same X-axis position on the keyboard. If the two keys are not in the same set, the destinations corresponding with the previously depressed key are muted in step 508. The "A" data item is then shifted into the "B" position in step 511. Elapsed time between present and the time shown in "B" is then measured and recorded in "Longtime" in step 513. If no other SKS keys are down as determined in step 499, then elapsed time between present and the time shown in "C" is measured and recorded in "Longtime" in step 514. It is then determined in step 520 whether the elapsed time measured in step 513 or 514 is greater than 400 milliseconds. If not, the elapsed time is recorded in "Longtime" in step 522. An arpeggiation rate as a function of the "Longtime" value is then calculated in step 525. The active key's ID number and the present time are then recorded in the "A" position in step 527. An index number of one is then established in step 528, indexing the first destination in the active key's pigeonhole. A note-off command is then sent for the indexed destination listed in the pigeonhole of the active key in step 529. A note-on command is then sent for the same destination in step 533. It is then determined in step 535 whether all destinations listed in the active key's pigeonhole have been muted and triggered. If not, a pause is implemented in step 536. This pause is based on the arpeggiation rate calculated in step 525. The index number is then increased by one in step 538. Step 529 is then returned to and steps 529–535 are performed until note-off/note-on commands have been sent for all destinations listed in the active key's pigeonhole (typically step 536 will be performed five times). After the loop is exited the active key's ID # is entered into the Aftertouch Register in step 541.

Figure 12B:
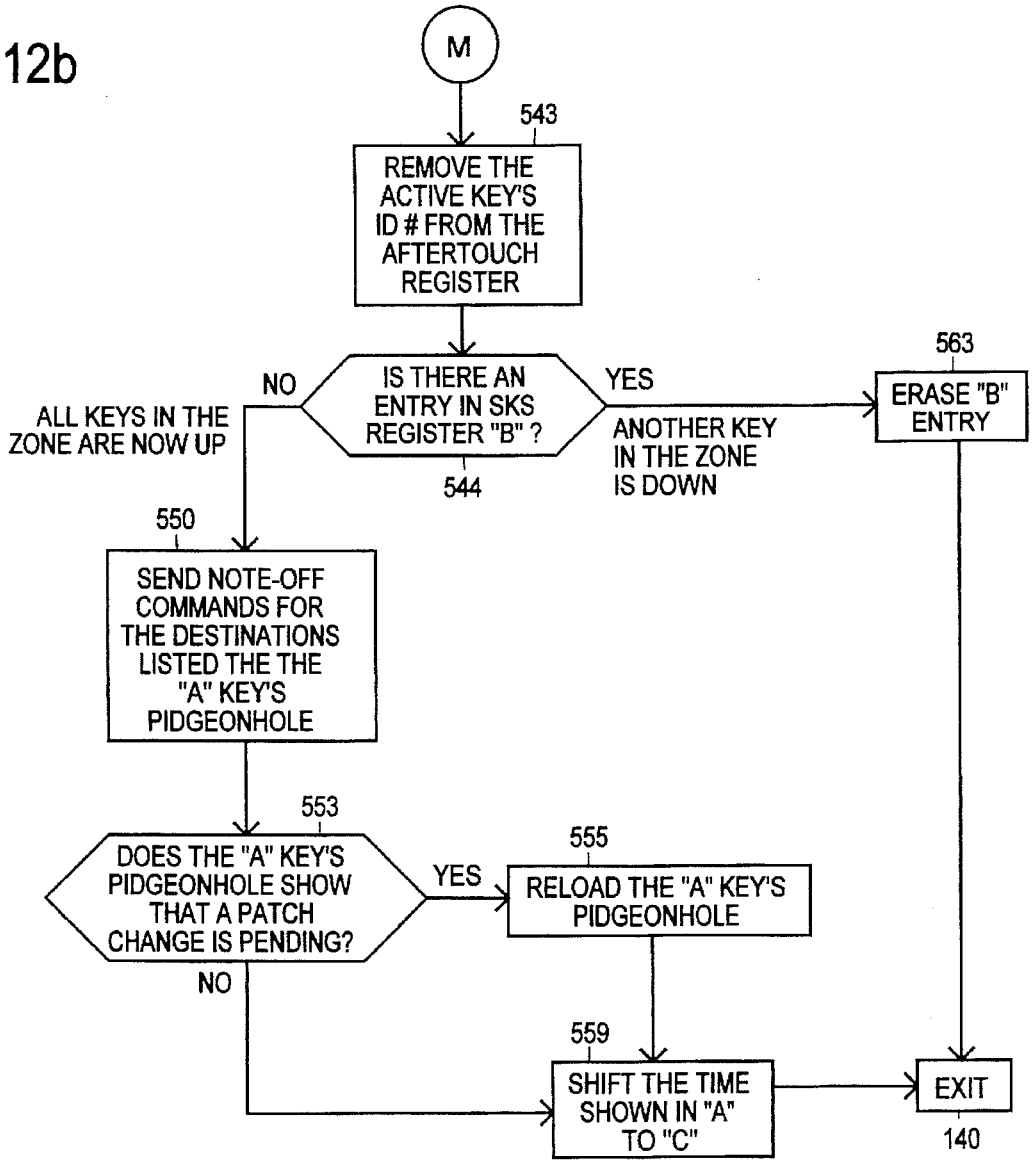
Figure 1:
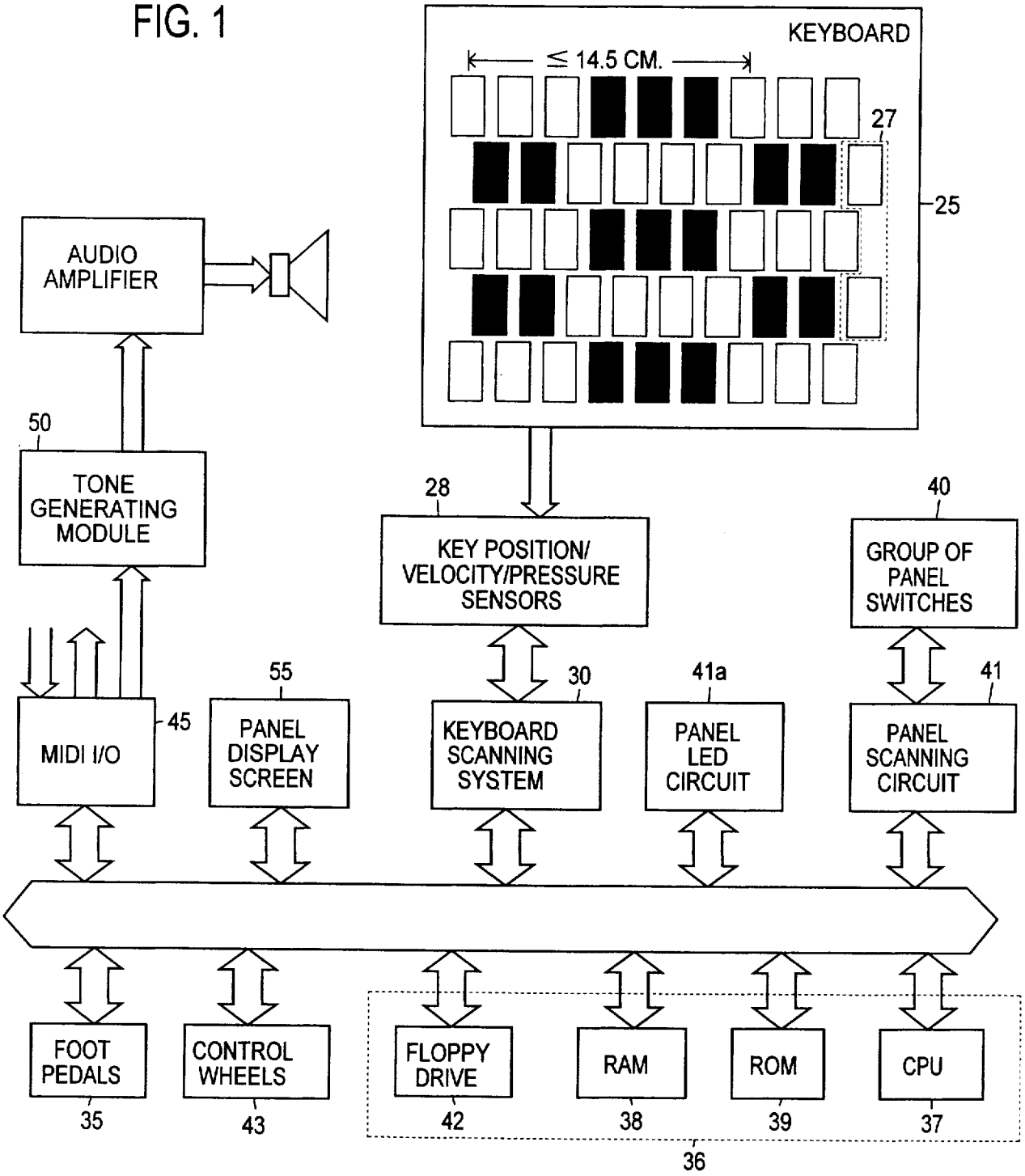
Figure 6:
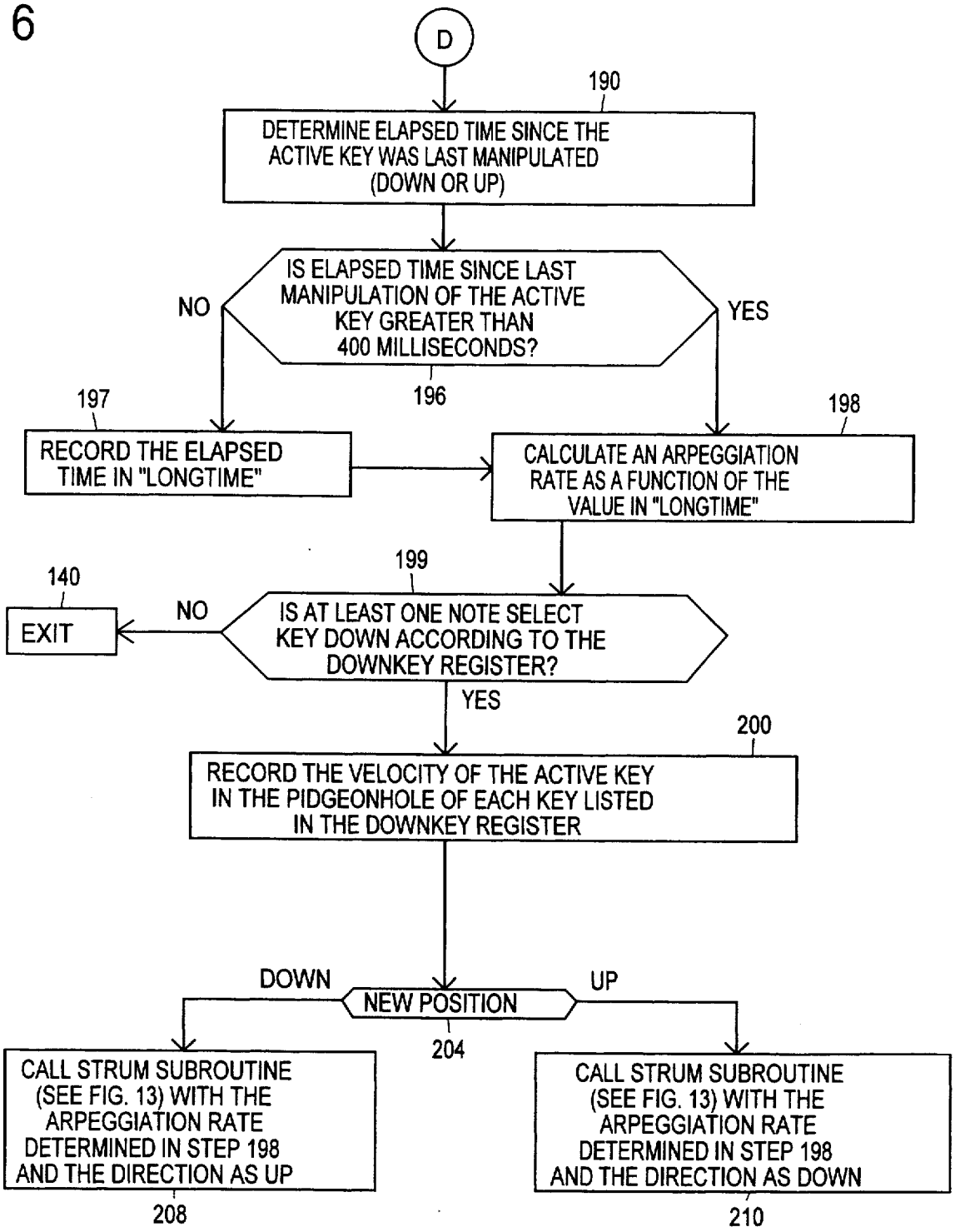

If the active key's new position is up, the active key's ID # is removed from the Aftertouch Register in step 543 (see FIG. 12*b*). The SKS Register is then checked in step 544 to determine whether there is a data item in position "B", and thus, whether another key in the SKS zone is down. If there is no "B" data item, then no keys in the zone are down and note-off commands are sent for the destinations listed in the pigeonhole of the key shown in the SKS Register "A" position in step 550. The pigeonhole of the key whose destinations were just muted is then checked in step 553 to determine whether a patch change is pending for that key. If so, the key's pigeonhole is reloaded according to the patch shown in "Newpatch" in step 555. The time of key downstroke shown in "A" is then shifted to the SKS Register's "C" position and the "A" position is cleared in step 559. If it is determined in step 44 that there is a data item in the SKS Register "B" position, then another key within the SKS zone is still down. The "B" data item is then erased in step 563.

Referring again to FIG. 3, if it is determined in step 488 that the active key has no Typecode, then the active key performs no function, and the Keyprocessor Subroutine is exited in step 140.

The Strum Subroutine is shown in FIG. 13. This subroutine is called in steps 208, 210 (see FIG. 6), 253, 256 (see FIG. 7), 303 (see FIG. 8), 341, and 344 (see FIG. 9) with the following parameters: (1) a particular Downkey Register, (2) an arpeggiation rate, and (3) a strum direction of either ascending or descending. In the first step 600 the strum direction is determined. If the direction is ascending, an index (I) is set to 1 in step 610. This index is used as a reference number to select a particular depressed note select key which is listed in the Downkey Register to be processed in the loop which includes steps 630, 670, & 687. With the index set to 1, the first (lowest musical pitch) key listed in the register is selected. If the direction is descending, the index is set to the same number as the total number of keys listed in the Downkey Register in step 620. Typically, this number is approx. 4 or 5, since this is the number of keys which a user will typically hold down with one hand to form a guitar-like chord. It should be noted that with a Janko Keyboard or other keyboard with a shortened octave, wide chords may be formed with one hand. The pigeonhole of the key corresponding with the index number is then checked in step 630 to determine whether the key is a Typecode 3 key (in a type 8 zone) with its alternate destination (typically a "click" sound) sustaining. If the indexed key is a Typecode 2 key, then there is no alternate destination, and step 660 is called. If the indexed key is a Typecode 3 key without a notation that the alternate destination is sustaining, then step 660 is also called. In step 660, a note-off command is sent for the primary destination. If it is determined in step 630 that the indexed key is a Typecode 3 key with its alternate destination sustaining, a note-off command is sent for the alternate destination in step 640. The notation indicating that the alternate destination is sustaining is then removed from the indexed key's pigeonhole in step 650. The pigeonhole of the indexed key is then checked for a notation that a patch change is pending in step 670. If so, the pigeonhole is then cleared and reloaded according to the patch shown in "Newpatch" in step 680. The pigeonhole of the indexed key is then checked in step 687 to determine whether the key is a Typecode 3 key (a key in a type 8 zone). If not, a note-on command is sent for the primary destination in the indexed key's pigeonhole in step 693. The velocity component of this command is taken from the indexed key's pigeonhole. If the key is a Typecode 3 key, the aftertouch value recorded in the key's pigeonhole is then checked in step 700 to determine whether the key is being depressed with sufficient pressure to exceed the primary/alternate note threshold. If so, a note-on command is sent for the primary destination in step 693. If the indexed key is being depressed lightly, i.e., with insufficient pressure to exceed the threshold, then a note-on command is sent for the alternate destination in step 707. The velocity component of this command is taken from the indexed key's pigeonhole. This alternate destination is typically a "click" sound. A notation is then made in the indexed key's pigeonhole that the key's alternate destination is currently sustaining in step 714. The strum direction is then determined again in step 733. If the direction is ascending, it is then determined in step 735 whether the loop including steps 630, 670, & 687 has been performed for all keys in the Downkey Register. If so, the subroutine is exited in step 140. If not, the index number is increased by one in step 740. If it is determined in step 733 that the direction is descending, it is then determined in step 714 whether the loop including steps 630, 670, & 687 has been performed for all keys in the Downkey Register. If not, the index number is reduced by one in step 747. A brief pause is then inserted in the program in step 755. The length of this pause (e.g., one millisecond) is calculated as a function of the arpeggiation rate. Step 630 is then returned to for the next key listed in the Downkey Register.

The Aftertouch Subroutine is shown in FIG. 14. This subroutine is called in step 75 (see FIG. In the first step 800 of this subroutine, the Aftertouch Register is checked to determine when the subroutine was last entered. This time is compared with the present time to determine whether less than one millisecond has elapsed since the subroutine was last entered. If so, the subroutine is exited and step 70 (see FIG. 2) is called in step 807. A 1 ms interval is included between runs of this subroutine because the MIDI protocol requires this time period to send an aftertouch message. Thus, as far as MIDI is concerned, there is no purpose in updating aftertouch values more frequently than once per millisecond. Rather, it is desired that step 70 be arrived at frequently, so that new key movement information may be processed as soon as possible after it is received from the daughter sense boards. Also, when a daughter board is multiplexed for an A/D conversion, it is prevented from scanning for new key movement. If more than 1 ms has elapsed, the present time is recorded in the Aftertouch Register in step 814. It is then determined in step 820 whether any keys are listed in the Aftertouch Register and, thus, whether any relevant keys (i.e., keys for which aftertouch is to be measured) are down. If no relevant keys are down, the subroutine is exited. If at least one relevant key is down, an index number of one is established in step 825. This index number refers to the fast key in the Aftertouch Register. An index number of two refers to the second key, and so forth. In the next step 830, the pigeonhole of the indexed key is checked to determine whether less than 200 milliseconds has elapsed since the key was depressed. This is the "debounce" time allotted for the key to finish its bouncing which naturally occurs when bottom-of-travel is reached. If less than 200 ms has elapsed, step 870 (discussed below) is called. If more than 200 ms has elapsed, the indexed key's daughter microcontroller (see FIG. 12 of copending U.S. patent application Ser. No. 08/345,067, reference numeral 480) is instructed to multiplex the indexed key's phototransistor sensor to the A/D converter in the CPU 37 in step 835 so that an A/D conversion may be performed to determine precise key position and thus aftertouch pressure. In the next step 840 a pause of approx. 50 microseconds is carried out to compensate for rise/fall times within the photointerrupter. An A/D conversion is then performed on the indexed key in step 845. It is then determined in step 850 whether the indexed key is a Typecode 3 key. If so, it is then determined in step 855 whether the new aftertouch value is less than the primary note threshold. If so, the user is pressing softly on the key and the previous aftertouch value (still in the key's pigeonhole) is then checked in step 860 to determine whether the user was previously pressing the key more softly than the primary note threshold. If not, the user has recently decreased pressure on the key and crossed the primary note threshold. This action with a Typecode 3 key is analogous to a guitar player releasing left hand pressure on a guitar string sufficiently to mute the string. Thus, a note-off command is sent for the indexed key's primary destination in step 863. The new aftertouch value is then recorded in the indexed key's pigeonhole in step 864. The subroutine is then exited in step 865 since the MIDI note-off command sent in step 863 requires one millisecond to send. There is thus no point in proceeding further until the message is sent. If step 863 is not arrived at, the new aftertouch value for the indexed key is entered into that key's pigeonhole in step 866. It is then determined in step 870 whether new aftertouch values have been measured for all keys in the Aftertouch Register. If not, the index number is increased by one in step 874. Step 830 is then returned to.

We turn our attention now to the portion of the Aftertouch Subroutine which is responsible for sending out aftertouch messages to the tone generating device. This portion is shown in FIG. 14*b*. Two types of flags are provided for selected items within the Aftertouch Register: eligibility flags and a single message flag. The message flag signifies that the attached data item is the next item for which an aftertouch message is to be sent. Each time an item is entered into the Aftertouch Register, a determination is made as to whether that item is eligible to receive the message flag. If so, an eligibility flag is attached to the item. Items which are eligible to receive the message flag are ID #s for keys which are designated for polyphonic aftertouch and heading numbers for mono aftertouch zones. Ineligible data items are keys within mono aftertouch or Note Select zones and heading numbers for Note Select zones. (In this embodiment of the invention aftertouch messages are never sent to the tone generating device for keys within a Note Select zone; although the keyboard could be engineered with this option.) If it is determined in step 870 that new aftertouch values have been provided for all keys in the Register, then the Register is checked in step 875 to determine whether there are any keys listed in the Register which are not in a Note Select zone subset. In other words, it is determined whether the user is holding down any keys for which aftertouch messages need to be sent to the tone generating module. Key data items within Note Select zone subsets may be easily skipped since Note Select zone headings do not include eligibility flags. If all keys in the Register are in a Note Select zone, the subroutine is exited. If there is at least one key in the Register for which it is desired that an aftertouch message be sent, the Register is then scanned for the message flag in step 882. If no message flag is found, it is then determined in step 885 whether the first non-note-select key in the Register is within a mono aftertouch zone. If not, the key is a poly aftertouch key and the message flag is placed on the key 's ID # data item in the Register in step 887. Step 904 is then called. If it is determined in step 885 that the first non-note-select key in the Register is within a mono aftertouch zone, the message flag is then placed on the heading data item for the key's zone number in step 889. Step 912 is then called. If the message flag is found in step 882, it is then determined in step 900 whether the flagged data item is a mono aftertouch zone heading or a poly aftertouch key. If the flagged item is a key, an aftertouch message is sent for the key in step 904. Information for this message, including the recently measured aftertouch value and the MIDI destination, is taken from the key's pigeonhole. If the flagged item is a zone heading, it is determined in step 906 whether any keys are listed under this heading, i.e., whether any keys within the zone are down. If not, no aftertouch message can be sent for the zone and the flag needs to be moved to the next eligible data item in the hope that that item will have a corresponding depressed key. The process of moving the message flag to the next eligible item is carried out in steps 907–909. In the first step 907 of this process it is determined whether the flagged item is the last item in the Register. If so, the message flag is moved to the first eligible item in the Register in step 908. If not, the message flag is moved to the next eligible item in step 909. Step 900 is then returned to. If it is determined in step 906 that there is at least one key listed in the flagged subset, then an average aftertouch value is calculated from the aftertouch values in the pigeonholes of all the listed keys in step 912. An aftertouch command including this average value is then sent to the tone generating device in step 916. The destination (e.g., MIDI channel) for this command is taken from the flagged subset as entered during step 65 or step 436. The message flag is then moved to the next eligible item in steps 920–928 which are identical to steps 907–909 discussed above. The subroutine is then exited.

As an alternative to the method shown, two aftertouch registers may be provided. The first register would list depressed keys for which aftertouch values need to be measured; the second would list depressed poly-aftertouch keys and mono-aftertouch zones for which aftertouch messages need to be sent to the tone generating device. This alternative would add steps insofar as some keys would have to be entered into (and deleted from) two aftertouch registers instead of one, but several steps in the Aftertouch subroutine would be simplified, including steps 875,908, 909, 924, & 928. As another option, Note Select keys may be entered only into the Downkey Register in step 165; and the keys listed in both the Downkey and Aftertouch Registers may be processed in steps 830–874.

Other MIDI functions such as real time volume control, pitch bend, modulation, etc. have not been discussed in detail in this specification, but may easily be included in the software by a person of ordinary skill in the art.

The preferred embodiment hereinabove described is intended as one possible embodiment of the invention. The above described flow charts may be modified in numerous ways while still retaining the essential features of the invention. Numerous different key position sensing systems and methods may be employed. Many other modifications are possible as well. The scope of the invention is thus in no way to be considered limited by the preferred embodiment described above; but rather, by the allowed claims and their equivalents.

I claim:

1. A polyphonic electronic musical instrument comprising:

a keyboard;

said keyboard including 24 independently-moving keys arranged in at least two key rows, 24 key velocity sensors, each of said sensors corresponding with one of said keys;

a digital signal processing system receiving key state information from said keyboard; and a tone generating device capable of simultaneously producing a plurality of independently triggered audio tones, said tone generating device controlled, at least in part, by said processing system; wherein said 24 keys are grouped into twelve key sets, each of said key sets including two keys occupying different key rows; and for any one of said keys, said processing system (a) issues to said tone generating device a note-on/velocity command for a corresponding tone as a result of depression only when the other key within the same set is in rest position, said command including information regarding the velocity at which said key was depressed; and (b) allows said tone generating device to continue production of said corresponding tone as long as either or both keys of the same set are in depressed position.

2. A polyphonic electronic musical instrument as in claim 1 wherein;

the tones corresponding with the keys of at least one of said key sets comprise the same musical note.

3. A polyphonic electronic musical instrument as in claim 1 wherein;

the tones corresponding with the keys of at least one of said key sets are identical.

4. A polyphonic electronic musical instrument as in claim 1 further comprising:

a memory device capable of recording key position information; wherein said processing system consults said memory device when any key within any of said key sets is depressed to determine whether the other key of the same set is in depressed position.

5. A polyphonic electronic musical instrument as in claim 1 further comprising:

a keyboard scanning system capable of scanning said keyboard to determine whether selected keys are in rest or depressed position; wherein whenever any one key within any one of said key sets is depressed, said scanning system is employed to determine whether the other key of the same set is in depressed position.

6. A polyphonic electronic musical instrument as in claim 1 wherein;

said processing system commands said tone generating device to initiate and terminate said corresponding tone without regard to whether any of said keys within other of said key sets are depressed.

7. A polyphonic electronic musical instrument as in claim 1 wherein;

said keyboard comprises a first key row, a second key row, a third key row, and a fourth key row;

said rows extend longitudinally from left to right;

said second key row is laterally positioned between said first and third rows;

said third key row is laterally positioned between said second and fourth rows;

at least a plurality of keys within said first row are laterally aligned with a plurality of keys within said third row;

at least a plurality of keys within said second row are laterally aligned with a plurality of keys within said fourth row; and at least a plurality of keys within said second row are staggered in the longitudinal dimension halfway between adjacent keys of the first row.

8. A polyphonic electronic musical instrument as in claim 7 wherein;

at least one of said key sets comprises a key of said first row and a key of said third row; and said first row key and said third row key are laterally aligned.

9. A polyphonic electronic musical instrument as in claim 7 wherein;

said tone generating device produces six tones corresponding with six adjacent keys within one of said key rows;

said six tones each comprise a musical note;

said six musical notes are (a) different from each other;

(b) members of a twelve-tone equal-tempered scale;

(c) span a musical interval of one minor-seventh; and no two of said six notes are one semitone apart; whereby said six notes constitute a whole-tone scale.

10. A polyphonic electronic musical instrument as in claim 1 wherein;

said processing system communicates with said tone generating device via a standardized digital protocol.

11. A polyphonic electronic musical instrument as in claim 10 wherein;

said protocol is selected from the group consisting of MIDI and ZIPI.

12. A method for controlling a polyphonic musical tone generating device from a keyboard, said keyboard including 24 independently-moving keys arranged in at least two key rows; comprising:

grouping said keys into twelve key sets, each of said key sets including two keys;

positioning the keys within any one of said key sets in different key rows;

depressing any one of said keys when the other key of the same set in rest position;

measuring the velocity at which said key was depressed, issuing to said tone generating device a note-on/velocity command for a tone corresponding with said key, said command including information regarding the velocity at which said key was depressed; and allowing said tone generating device to continue production of said tone as long as either key within said one of said key sets is in depressed position.

13. A method as in claim 12 wherein;

said note-on/velocity command conforms with a standardized digital protocol.

14. A method as in claim 13 wherein;

said standardized digital protocol is selected from the group consisting of MIDI and ZIPI.

15. A method as in claim 12 further comprising:

maintaining a continuous record of key position information in a memory register; and consulting said memory register when either said key within any of said key sets is depressed to determine whether another key of the same set is in depressed position.

16. A method as in claim 12 further comprising:

scanning at least one key within any one of said key sets whenever a key within the same set is depressed to determine whether another key of the same set is in depressed position.

17. A method as in claim 12 wherein;

the tones corresponding with the keys within at least one of said key sets comprise the same musical note.

18. A method as in claim 12 wherein;

the tones corresponding with the keys of at least one key set are identical.

19. A method as in claim 12 wherein;

said keyboard comprises a first key row, a second key row, a third key row, and a fourth key row;

said rows extend longitudinally from left to right;

said second key row is laterally positioned between said first and third rows;

said third key row is laterally positioned between said second and fourth rows;

at least a plurality of keys within said first row are laterally aligned with a plurality of keys within said third row;

at least a plurality of keys within said second row are laterally aligned with a plurality of keys within said fourth row; and at least a plurality of keys within said second row are staggered in the longitudinal dimension halfway between adjacent keys of the first row.

20. A method as in claim 19 wherein;

at least one of said key sets comprises a key of said first row and a key of said third row; and said first row key and said third row key are laterally aligned.

21. A method as in claim 19 wherein;

said tone generating device produces six tones corresponding with six adjacent keys within one of said key rows;

said six tones each comprise a musical note;

said six musical notes are (a) different from each other;

(b) members of a twelve-tone equal-tempered scale;

(c) span a musical interval of one minor-seventh; and no two of said six notes are one semitone apart; whereby said six notes constitute a whole-tone scale.

22. A polyphonic electronic musical instrument comprising:

a keyboard;

said keyboard including 24 independently-selectable keys arranged in at least two key rows, a digital signal processing system receiving key state information from said keyboard; and a tone generating device capable of simultaneously producing a plurality of independently triggered audio tones, said tone generating device controlled, at least in part, by said processing system; wherein said 24 keys are grouped into twelve key sets, each of said key sets including two keys occupying different key rows;

for any one of said keys, said processing system commands said tone generating device to initiate production of a corresponding tone as a result of key selection;

when any one of said keys is in selected state as the other said key within the same set is selected, said processing system commands said tone generating device to (a) terminate production of the tone corresponding with the previously selected key;

(b) initiate production of the tone corresponding with the newly selected key; and for each key set, the tones corresponding with the keys within that set comprise the same musical note.

23. A polyphonic electronic musical instrument as in claim 22 wherein;

said processing system terminates production of the tone corresponding with the previously selected key within the set before initiating production of the tone corresponding with the newly selected key.

24. A polyphonic electronic musical instrument as in claim 23 wherein;

whenever any key within any of said key sets is selected, said processing system commands said tone generating device to terminate production of the tones corresponding with all keys within the set.

25. A polyphonic electronic musical instrument as in claim 22 wherein;

the tones corresponding with the keys of at least one key set are identical.

26. A polyphonic electronic musical instrument as in claim 22 wherein;

said processing system commands said tone generating device to initiate and terminate said corresponding tones without regard to whether any of said keys within other said key sets are selected.

27. A polyphonic electronic musical instrument as in claim 22 wherein;

said processing system includes a memory device capable of recording key state information; and said processing system (a) consults said memory device when any key within any of said sets is selected to determine whether another key of the same set is in selected state, and upon determination that at least one other key of the set is in selected state;

(b) commands said tone generating device to terminate production of at least one tone corresponding with at least one key within the set.

28. A polyphonic electronic musical instrument as in claim 22 wherein;

said processing system includes a keyboard scanning device capable of scanning said keyboard to determine whether selected keys are in rest or selected state; and said processing system (a) scans the keys of any one of said key sets whenever a key of the same set is selected to determine whether another key of the same set is in selected state, and upon determination that at least one other key of the set is in selected state;

(b) commands said tone generating device to terminate production of at least one tone corresponding with at least one key within the set.

29. A polyphonic electronic musical instrument as in claim 22 wherein;

said keyboard comprises a first key row, a second key row, a third key row, and a fourth key row;

said rows extend longitudinally from left to right;

said second key row is laterally positioned between said first and third rows;

said third key row is laterally positioned between said second and fourth rows;

at least a plurality of keys within said first row are laterally aligned with a plurality of keys within said third row;

at least a plurality of keys within said second row are laterally aligned with a plurality of keys within said fourth row; and at least a plurality of keys within said second row are staggered in the longitudinal dimension halfway between adjacent keys of the first row.

30. A polyphonic electronic musical instrument as in claim 29 wherein;

at least one of said key sets comprises a key of said first row and a key of said third row; and said first row key and said third row key are laterally aligned.

31. A polyphonic electronic musical instrument as in claim 29 wherein;

said tone generating device produces six tones corresponding with six adjacent keys within one of said key rows;

said six tones each comprise a musical note;

said six musical notes are (a) different from each other;

(b) members of a twelve-tone equal-tempered scale;

(c) span a musical interval of one minor-seventh; and no two of said six notes are one semitone apart; whereby said six notes constitute a whole-tone scale.

32. A polyphonic electronic musical instrument as in claim 22 wherein;

said processing system communicates with said tone generating device via a standardized digital protocol.

33. A polyphonic electronic musical instrument as in claim 32 wherein;

said protocol is selected from the group consisting of MIDI and ZIPI.

34. A method for controlling a polyphonic musical tone generating device from a keyboard, said keyboard including 24 independently-selectable keys arranged in at least two key rows; comprising:

grouping said keys into twelve key sets, each of said key sets including two keys;

positioning the keys within any one of said key sets in different key rows;

selecting any one of said keys, thereby commanding said tone generating device to initiate production of a first tone corresponding with said key, said first tone including a musical note; and while holding said key in selected state, selecting the other key within the same key set, thereby commanding said tone generating device to terminate production said first tone and initiate production of a second tone corresponding with said other key, said second tone including the same musical note as said first tone.

35. A method as in claim 34 wherein;

said first and second tones are identical.

36. A method as in claim 34 wherein;

said keyboard comprises a first key row, a second key row, a third key row, and a fourth key row;

said rows extend longitudinally from left to right;

said second key row is laterally positioned between said first and third rows;

said third key row is laterally positioned between said second and fourth rows;

at least a plurality of keys within said first row are laterally aligned with a plurality of keys within said third row;

at least a plurality of keys within said second row are laterally aligned with a plurality of keys within said fourth row; and at least a plurality of keys within said second row are staggered in the longitudinal dimension halfway between adjacent keys of the first row.

37. A method as in claim 36 wherein;

at least one of said key sets comprises a key of said first row and a key of said third row; and said first row key and said third row key are laterally aligned.

38. A method as in claim 36 wherein;

said tone generating device produces six tones corresponding with six adjacent keys within one of said key rows;

said six tones each comprise a musical note;

said six musical notes are (a) different from each other;

(b) members of a twelve-tone equal-tempered scale;

(c) span a musical interval of one minor-seventh; and no two of said six notes are one semitone apart; whereby said six notes constitute a whole-tone scale.

39. A polyphonic electronic musical instrument comprising:

a keyboard;

said keyboard including 24 independently-moving keys arranged in at least two key rows, 24 key velocity sensors, each of said sensors corresponding with one of said keys;

a digital signal processing system receiving key state information from said keyboard; and a tone generating device capable of simultaneously producing a plurality of independently triggered audio tones, said tone generating device controlled, at least in part, by said processing system; wherein said 24 keys are grouped into twelve key sets, each of said key sets including two keys occupying different key rows; and for any one of said keys, said processing system issues to said tone generating device a note-on/velocity command for a tone corresponding with said key as a result of depression of said key at least when the other key within the same set is in rest position, said command including information regarding the velocity at which said key was depressed;

said processing system also (a) allows said tone generating device to continue production of said tone when either key within the same set is released as the other key within the same set is held in depressed position; and (b) commands said tone generating device to terminate production of said previously triggered tone when the last remaining depressed key within the same key set is released.

40. An electronic musical instrument as in claim 39 wherein, said processing system commands said tone generating device to terminate production of the tones corresponding with all the keys of any one of said key sets when the last remaining depressed key of the same key set is released.

41. An electronic musical instrument as in claim 39 wherein;

the tones corresponding with the keys of at least one key set comprise the same musical note.

42. An electronic musical instrument as in claim 39 wherein;

the tones corresponding with the keys of at least one key set are identical.

43. An electronic musical instrument as in claim 39 wherein;

said processing system includes a memory device capable of recording key position information; wherein said processing system (a) consults said memory device when either key within any of said key sets is released to determine whether the other key within the same set is in depressed position, and, upon determination that no keys within the set are in depressed position;

(b) commands said tone generating device to terminate production of a tone corresponding with a key within the set.

44. An electronic musical instrument as in claim 39 wherein;

said processing system includes a keyboard scanning device capable of scanning said keyboard to determine whether selected keys are in rest or depressed position; wherein said processing system (a) scans at least one key within any one of said key sets whenever another key of the same set is released to determine whether any keys within the set remain in depressed position, and, upon determination that no keys within the set are in depressed position;

(b) commands said tone generating device to terminate production of a tone corresponding with a key within the set.

45. A polyphonic electronic musical instrument comprising:

a keyboard;

said keyboard including 24 independently-selectable keys arranged in at least two key rows, a digital signal processing system receiving key state information from said keyboard; and a tone generating device capable of simultaneously producing a plurality of independently triggered audio tones, said tone generating device controlled, at least in part, by said processing system;

a function selecting mechanism providing a control input to said processing system, said mechanism enabling a user to select for said keys a sustain function operating mode or a repetition function operating mode; wherein said 24 keys are grouped into twelve key sets, each of said key sets including two keys occupying different key rows; and when one of said key sets is operating in said sustain function operating mode, said processing system (a) commands said tone generating device to initiate production of a tone corresponding with a key within said key set as a result of selection of that key only when the other key within the same set is in rest state, and (b) allows said tone generating device to continue production of said corresponding tone as long as at least any one key of the same set is in selected state; and when one of said key sets is operating in said repetition function operating mode, and a first key within said key set is in selected state as a second key within said key set is selected, said processing system commands said tone generating device to (a) terminate production of a tone corresponding with said first key, and (b) initiate production of a tone corresponding with said second key.

46. An electronic musical instrument as in claim 45 wherein;

the tones corresponding with the keys of at least one of said key sets comprise the same musical note.

47. An electronic musical instrument as in claim 45 wherein;

the tones corresponding with the keys of at least one of said key sets are identical.

48. An electronic musical instrument as in claim 45 wherein;

said processing system communicates with said tone generating device via a standardized digital protocol.

49. An electronic musical instrument as in claim 48 wherein;

said protocol is selected from the group consisting of MIDI and ZIPI.

* * * * *

UNITED STATES PATENT AND TRADEMARK OFFICE

CERTIFICATE OF CORRECTION

PATENT NO. : 5,648,630

DATED : July 15, 1997

INVENTOR(S) : Paul B. Vandervoort

It is certified that error appears in the above-identified patent and that said Letters Patent is hereby corrected as shown below:

Delete Drawing Sheets 1, 6, and 9b substitute therefor the Drawing Sheets, consisting of Figs. 1, 6, and 9b as shown on the attached pages.

Signed and Sealed this

Tenth Day of March, 1998

*Attest:*

*Attesting Officer*

BRUCE LEHMAN

*Commissioner of Patents and Trademarks*

United States Patent and Trademark Office

Certificate of Correction

Patent # 5,648,630
Issued July 15, 1997
Inventor: Paul B. Vandervoort

It is certified that error appears in the above-identified patent and that said patent is hereby corrected as shown below:

FIG. 1 should include the following features:

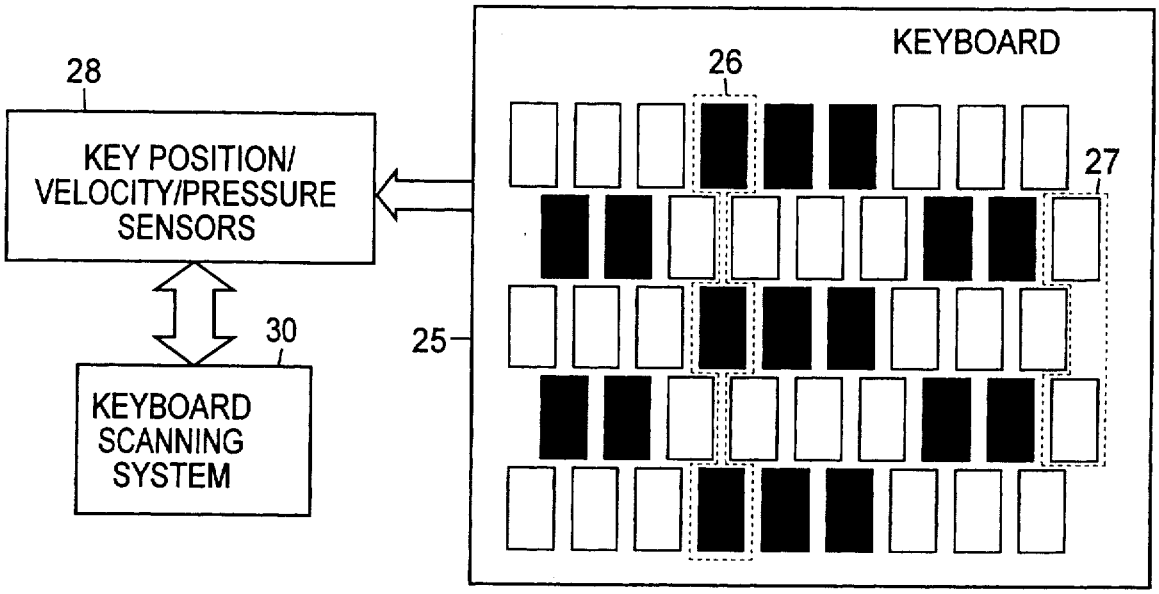

In FIG. 6, "NO" should appear to the left of the step 196 hexagon, and "YES" should appear to the right.

Also in FIG. 6, the arrow between boxes 197 & 198 should include a tip pointing from 197 to 198.

In FIG. 9b, the words "is typecode 6" do not belong.

In text column 7, lines 56 and 57, the word "dam" should be "data".

In text column 22, line 58, the characters "2)." should appear after "(see FIG.".

STRUM MODE 1 TRIGGER KEY SUBROUTINE